US007669641B2

(12) United States Patent
Rembold et al.

(10) Patent No.: US 7,669,641 B2
(45) **Date of Patent: *Mar. 2, 2010**

(54) METHOD AND SYSTEM FOR VERTICAL COIL CONDENSATE DISPOSAL

(75) Inventors: Thomas K. Rembold, Danville, IN (US); Arturo Rios, Avon, IN (US); Jason M. Thomas, Morgantown, IN (US); Floyd J. Frenia, Brownsburg, IN (US); Michael V. Hubbard, Pittsboro, IN (US)

(73) Assignee: Carrier Corporation, Farmington, CT (US)

( * ) Notice: Subject to any disclaimer, the term of this patent is extended or adjusted under 35 U.S.C. 154(b) by 911 days.

This patent is subject to a terminal disclaimer.

(21) Appl. No.: 11/336,382

(22) Filed: Jan. 20, 2006

(65) Prior Publication Data

US 2007/0169494 A1 Jul. 26, 2007

(51) Int. Cl.
*F24D 5/10* (2006.01)
*F28D 1/053* (2006.01)

(52) U.S. Cl. ..... 165/53; 165/150

(58) Field of Classification Search ..... 62/285, 62/286, 298; 165/76, 126, 53, 149, 150
See application file for complete search history.

(56) References Cited

U.S. PATENT DOCUMENTS 2,599,965 A * 6/1952 Young ..... 165/134.1
3,383,878 A 5/1968 Booth
3,823,770 A * 7/1974 DueII et al. ..... 165/76
3,831,670 A 8/1974 Mullings
4,000,779 A 1/1977 Irwin
4,083,198 A * 4/1978 Dennis ..... 62/285
4,129,013 A 12/1978 Hine, Jr.
4,474,232 A 10/1984 Wright et al.
4,597,269 A 7/1986 Kim
4,687,604 A 8/1987 Goetti
4,856,672 A 8/1989 Sullivan
4,905,474 A 3/1990 Larinoff
5,071,027 A 12/1991 Sullivan
5,105,630 A 4/1992 Kim
5,152,154 A 10/1992 Sullivan
5,207,074 A 5/1993 Cox et al.
5,613,554 A * 3/1997 Bull et al. ..... 165/150
5,664,431 A 9/1997 Martin, Sr.
5,715,697 A 2/1998 Rust, Jr. et al.
5,904,053 A 5/1999 Polk et al.
5,979,171 A 11/1999 Mitchell et al.
5,987,909 A 11/1999 Martin, Sr.
6,112,536 A 9/2000 Hansen
6,182,745 B1 * 2/2001 Potier ..... 165/149
6,276,443 B1 * 8/2001 Martin, Sr. ..... 165/126
6,360,911 B1 3/2002 Arnold
6,405,552 B1 6/2002 Hubert et al.
6,435,265 B1 * 8/2002 Lakdawala et al. ..... 165/53
6,591,627 B1 * 7/2003 Rollins ..... 62/285
6,729,152 B2 * 5/2004 Gully et al. ..... 62/276
6,895,770 B1 5/2005 Kaminski
6,901,766 B1 * 6/2005 Jin et al.

(Continued)

*Primary Examiner*—Frantz Jules
*Assistant Examiner*—Emmanuel Duke
(74) *Attorney, Agent, or Firm*—Kinney & Lange, P.A.

(57) ABSTRACT

Condensate formed on a vertically oriented multi-poise evaporator coil is directed from a coil slab to a shield configured to attach to a bottom of the coil slab. The condensate is then drained out of the shield and into a condensate pan.

13 Claims, 21 Drawing Sheets

U.S. PATENT DOCUMENTS 6,978,909 B2 12/2005 Goetzinger et al.
7,263,850 B2 9/2007 Eom et al.
2006/0112683 A1 6/2006 Huber
2007/0169493 A1* 7/2007 Rios ..... 62/285

* cited by examiner

METHOD AND SYSTEM FOR VERTICAL COIL CONDENSATE DISPOSAL

CROSS-REFERENCE TO RELATED APPLICATION(S)

The following application is filed on the same day as the following co-pending applications: "METHOD AND SYSTEM FOR HORIZONTAL COIL CONDENSATE DISPOSAL" by inventors Arturo Rios, Floyd J. Frenia, Jason Michael Thomas, Michael V. Hubbard, and Thomas K. Rembold (application Ser. No. 11/337,106); "CASING ASSEMBLY SUITABLE FOR USE IN A HEAT EXCHANGE ASSEMBLY" by inventors Floyd J. Frenia, Arturo Rios, Thomas K. Rembold, Michael V. Hubbard, Jason Michael Thomas, and Stephen R. Carlisle (application Ser. No. 11/336,278); "CONDENSATE PAN INSERT" by inventors Jason Michael Thomas, Floyd J. Frenia, Thomas K. Rembold, Arturo Rios, Michael V. Hubbard, and Dale R. Bennett (Ser. No. 11/336,626); "CASING ASSEMBLY SUITABLE FOR USE IN A HEAT EXCHANGE ASSEMBLY" by inventors Arturo Rios, Thomas K. Rembold, Jason Michael Thomas, Stephen R. Carlisle, and Floyd J. Frenia (application Ser. No. 11/337,157); "LOW-SWEAT CONDENSATE PAN" by inventors Arturo Rios, Floyd J. Frenia, Thomas K. Rembold, Michael V. Hubbard, and Jason Michael Thomas (application Ser. No. 11/336,648); "CONDENSATE PAN INTERNAL CORNER DESIGN" by inventor Arturo Rios (application Ser. No. 11/337,107); "VERTICAL CONDENSATE PAN WITH NON-MODIFYING SLOPE ATTACHMENT TO HORIZONTAL PAN FOR MULTI-POISE FURNACE COILS" by inventor Arturo Rios (application Ser. No. 11/337,100); "CONDENSATE SHIELD WITH FASTENER-FREE ATTACHMENT FOR MULTI-POISE FURNACE COILS" by inventor Arturo Rios (application Ser. No. 11/336,381); and "SPLASH GUARD WITH FASTENER-FREE ATTACHMENT FOR MULTI-POISE FURNACE COILS" by inventor Arturo Rios (application Ser. No. 11/336,651), which are incorporated herein by reference.

BACKGROUND

The present invention relates generally to a method and system for disposing of condensation formed on an evaporator coil. More particularly, the invention relates to a method and system for removing the condensate from a coil slab of a multi-poise coil oriented vertically and directing the condensate to a condensate pan.

In a conventional refrigerant cycle, a compressor compresses a refrigerant and delivers the compressed refrigerant to a downstream condenser. From the condenser, the refrigerant passes through an expansion device, and subsequently, to an evaporator. The refrigerant from the evaporator is returned to the compressor. In a split system heating and/or cooling system, the condenser may be known as an outdoor heat exchanger and the evaporator as an indoor heat exchanger, when the system operates in a cooling mode. In a heating mode, their functions are reversed.

In the split system, the evaporator is typically a part of an evaporator assembly coupled with a furnace. However, some cooling systems are capable of operating independent of a furnace. A typical evaporator assembly includes an evaporator coil (e.g., a coil shaped like an "A", which is referred to as an "A-frame coil") and a condensate pan disposed within a casing. An A-frame coil is typically referred to as a "multi-poise" coil because it may be oriented either horizontally or vertically in the casing of the evaporator assembly.

During a cooling mode operation, a furnace blower circulates air into the casing of the evaporator coil assembly, where the air cools as it passes over the evaporator coil. The blower then circulates the air to a space to be cooled. Depending on the particular application, an evaporator assembly including a vertically oriented A-frame coil may be an up flow or a down flow arrangement. In an up flow arrangement, air circulated upwards, from beneath the evaporator coil assembly, whereas in a down flow arrangement, air is circulated downward, from above the evaporator coil assembly.

Refrigerant is enclosed in piping that is used to form the evaporator coil. If the temperature of the evaporator coil surface is lower than the dew point of air passing over it, the evaporator coil removes moisture from the air. Specifically, as air passes over the evaporator coil, water vapor condenses on the evaporator coil. The condensate pan of the evaporator assembly collects the condensed water as it drips off of the evaporator coil. The collected condensation then typically drains out of the condensate pan through a drain hole in the condensate pan.

BRIEF SUMMARY

Condensate formed on a vertically oriented multi-poise evaporator coil is directed from a coil slab to a shield configured to attach to a bottom of the coil slab. The condensate is then drained out of the shield and into a condensate pan.

DETAILED DESCRIPTION

Figure 1A:
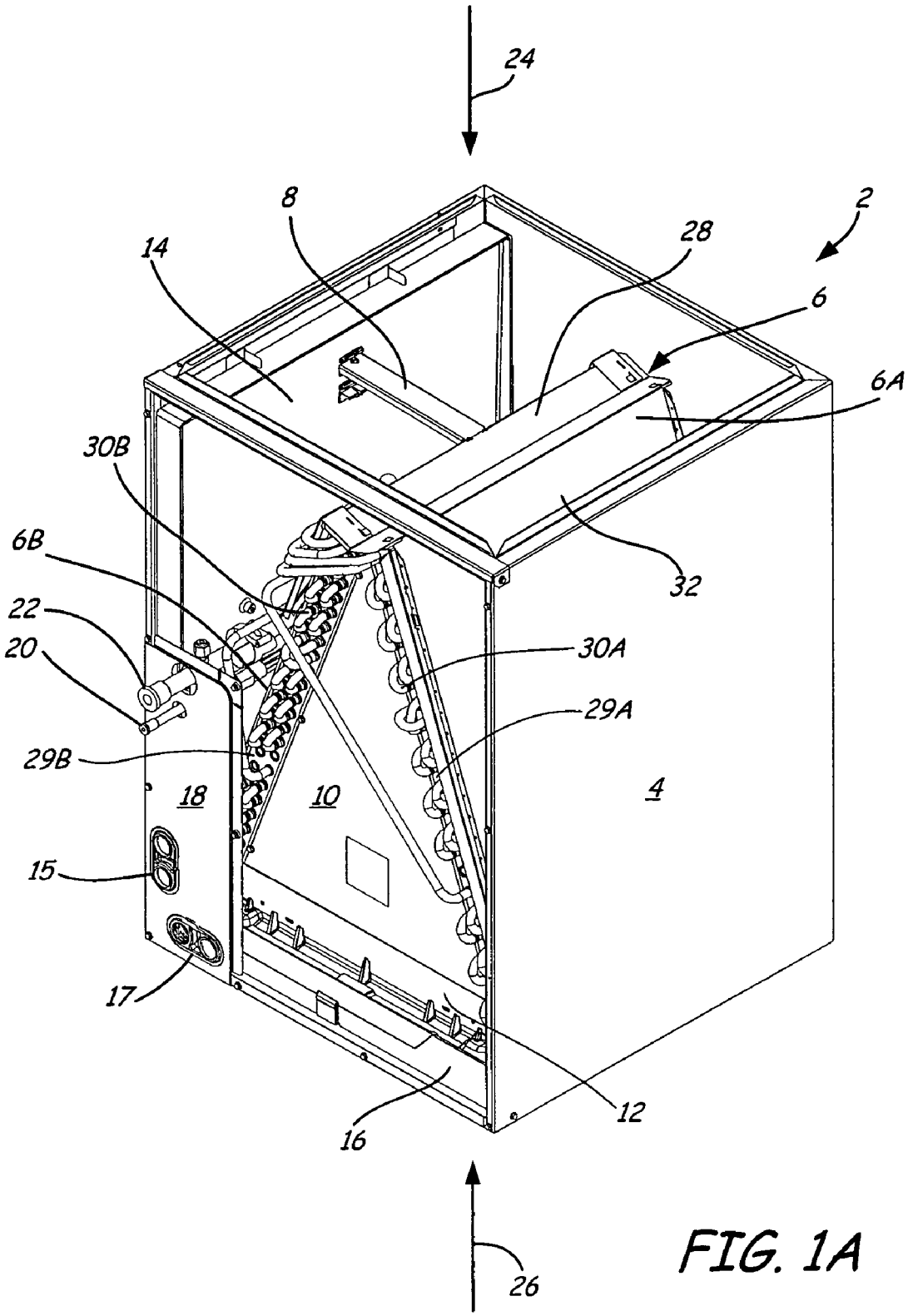
FIG. 1A is a perspective view of an evaporator assembly, which includes an evaporator coil and condensate pan disposed within a casing.
Figure 1B:
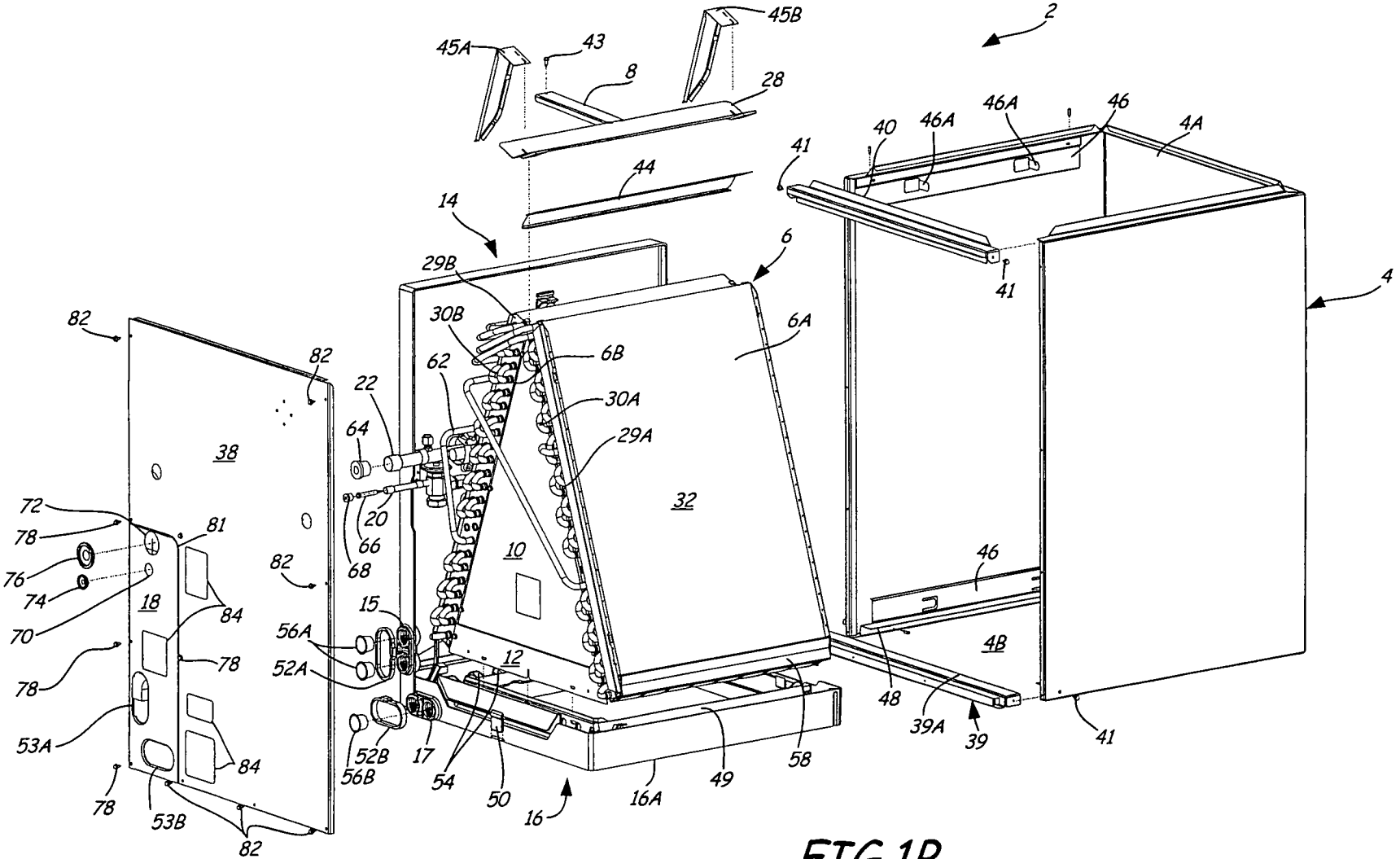
FIG. 1B is an exploded perspective view of the evaporator assembly of FIG. 1A.

The Evaporator Assembly (FIGS. 1A-1B)

FIG. 1A is a perspective view of evaporator assembly 2, which includes casing 4, A-frame evaporator coil ("coil") 6, coil brace 8, first delta plate 10, second delta plate 12, horizontal condensate pan 14, drain holes 15, vertical condensate pan 16, drain holes 17, first cover 18, input refrigerant line 20, and output refrigerant line 22. When evaporator assembly 2 is integrated into a heating and/or cooling system, evaporator assembly 2 is typically mounted above an air handler. The air handler includes a blower that cycles air through evaporator assembly 2. In a down flow application, the blower circulates air in a downward direction (indicated by arrow 24) through casing 4 and over coil 6. In an up flow application, the blower circulates air in an upward direction (indicated by arrow 26) through casing 4.

Coil 6, condensate pan 14, and condensate pan 16 are disposed within casing 4, which is preferably a substantially airtight space for receiving and cooling air. That is, casing 4 is preferably substantially airtight except for openings 4A and 4B (shown in FIG. 1B). In a down flow application, air is introduced into evaporator assembly 2 through opening 4A and exits through opening 4B. In an up flow application, air is introduced into evaporator assembly 2 through opening 4B and exits through opening 4A. In the embodiment shown in FIGS. 1A and 1B, casing 4 is constructed of a single piece of sheet metal that is folded into a three-sided configuration, and may also be referred to as a "wrapper". In alternate embodiments, casing 4 may be any suitable shape and configuration and/or formed of multiple panels of material.

Coil 6 is a multi-poise A-frame coil, and may be oriented either horizontally or vertically. The vertical orientation is shown in FIGS. 1A and 1B. In a horizontal orientation, casing 4 is rotated 90° in a counterclockwise direction. Coil brace 8 is connected to air seal 28 and helps support coil 6 when coil 6 is in its horizontal orientation.

Coil 6 includes first slab 6A and second slab 6B connected by air seal 28. A gasket may be positioned between air seal 28 and first and second slabs 6A and 6B, respectively, to provide an interface between air seal 28 and slabs 6A and 6B that is substantially impermeable to water. First and second delta plates 10 and 12, respectively, are positioned between first and second slabs 6A and 6B, respectively. First slab 6A includes multiple turns of piping 30A with a series of thin, parallel plate fins 32 mounted on piping 30A. Similarly, second slab 6B includes multiple turns of piping 30B with a similar series of thin, parallel fins mounted on piping 30B. Tube sheet 29A is positioned at an edge of slab 6A, and tube sheet 29B is positioned at an edge of slab 6B. Delta plates 10 and 12, and air seal 28, may be attached to tube sheets 29A and 29B.

In the embodiment shown in FIG. 1A, coil 6 is a two-row coil. However, in alternate embodiments, coil 6 may include any suitable number of rows, such as three, as known in the art. Refrigerant is cycled through piping 30A and 30B, which are in fluidic communication with one another (through piping system 62, shown in FIG. 1B). As FIG. 1A illustrates, coil 6 includes input and output lines 20 and 22, respectively, which are used to recycle refrigerant to and from a compressor (which is typically located in a separate unit from evaporator assembly 2). Refrigerant input and output lines 20 and 22 extend through first cover 18. Evaporator assembly 2 also includes access cover 38 (shown in FIG. 1B) adjacent to first cover 18, and together, first cover 18 and access cover 38 fully cover the front face of evaporator assembly 2 (i.e., the face which includes first cover 18). Access cover 38 will be described in further detail in reference to FIG. 1B.

As discussed in the Background section, if the temperature of coil 6 surface is lower than the dew point of the air moving across coil 6, water vapor condenses on coil 6. If coil 6 is horizontally oriented, condensation from coil 6 drips into condensate pan 14, and drains out of condensate pan 14 through drain holes 15, which are typically located at the bottom of condensate pan 14. If coil 6 is vertically oriented, condensate pan 16 collects the condensed water from coil 6, and drains the condensation through drain holes 17, which are typically located at the bottom of condensate pan 16.

Because evaporator assembly 2 includes horizontal condensate pan 14 and vertical condensate pan 16, evaporator assembly 2 is configured for applications involving a horizontal or vertical orientation of coil 6. In an alternate embodiment, evaporator assembly 2 is modified to be applicable to only a vertical orientation of coil 6, in which case horizontal condensate pan 14 and brace 8 are absent from evaporator assembly 2. In another alternate embodiment, evaporator assembly 2 excludes vertical condensate pan 16 such that evaporator assembly 2 is only applicable to horizontal orientations of coil 6.

FIG. 1B is an exploded perspective view of evaporator assembly 2 of FIG. 1A. Front deck 39 and upper angle 40 are each connected to casing 4 with screws 41. Another suitable method of connecting front deck 39 and upper angle 40 to casing 4 may also be used, such as welding, an adhesive, or rivets. Front deck 39 and upper angle 40 provide structural integrity for casing 4 and provide a means for connecting front cover 18 and access cover 38 to casing 4. Screw 43 attaches brace 8 (and thereby, air seal 28) to condensate pan 14. Of course, other suitable means of attachment may be used in alternate embodiments. In addition to air seal 28, air splitter 44 is positioned between first slab 6A and second slab 6B of coil 6 and is attached by tabs on tube sheets 29A and 29B of coil 6.

Horizontal and vertical condensate pans 14 and 16 are typically formed of a plastic, such as polyester, but may also be formed of any material that may be casted, such as metal (e.g., aluminum). Horizontal condensate pan 14 slides into casing 4 and is secured in position by pan supports 46. Tabs 46A of pan supports 46 define a space for condensate pan 14 to slide into. When coil 6 is in a horizontal orientation (and casing 4 is rotated about 90° in a counterclockwise direction), coil 6 is positioned above horizontal condensate pan 14 so that condensation flows from coil 6 into horizontal condensate pan 14. Air splitter 44 and splash guards 45A and 45B also help guide condensation from coil 6 into horizontal condensate pan 14.

Condensation that accumulates in horizontal condensate pan 14 eventually drains out of horizontal condensate pan 14 through drain holes 15. Gasket 52A is positioned around drain holes 15 prior to positioning first cover 18 over drain holes 15 in order to help provide a substantially airtight seal between drain holes 15 and first cover 18. First cover 18 includes opening 53A, which corresponds to and is configured to fit over drain holes 15 and gasket 52A. The substantially airtight seal helps prevent air from escaping from casing 4, and thereby increases the efficiency of evaporator assembly 2. Caps 56A may be positioned over one or more drain holes 15, such as when evaporator assembly 2 is used in an application in which coil 6 is vertically oriented.

Vertical condensate pan 16 slides into casing 4 and is supported, at least in part, by flange 48, which is formed by protruding sheet metal on three-sides of casing 4 and top surface 39A of front deck 39. Specifically, bottom surface 16A of condensate pan 16 rests on flange 48 and top surface 39A of front deck 39. Condensate pan 16 includes outer perimeter 49, insert 50, drain holes 17, which are sealed by gasket 52, and plurality of ribs 54.

One or more channels are positioned about outer perimeter 49 of vertical condensate pan 16 for receiving condensation from coil 6. In the vertical orientation of coil 6 illustrated in FIGS. 1A and 1B, coil 6 is positioned above vertical condensate pan 16 to allow condensation to flow along one slab 6A or 6B and eventually into one or more of the channels along outer perimeter 49 of vertical condensate pan 16. In this way, condensation collects in condensate pan 16. In some applications, such as when coil 6 includes three rows of coils, insert 50 is positioned in condensate pan 16 to help shield coil 6 from condensate blow-off from condensate pan 16.

Evaporator assembly 2 includes features, such as ribs 54 and shield 58, that are configured to help direct condensation into the one or more channels along outer perimeter 49 of vertical condensate pan 16 (when coil 6 is vertically oriented). Shield 58 is attached to tube sheet 29A and is configured to both guide condensation into a channel along outer perimeter 49 of condensate pan 16 and help protect coil 6 from condensation blow-off, which occurs when condensation that is collected in condensate pan 16 is blown into the air stream moving through evaporator assembly 2. A similar shield is attached to tube sheet 29B.

Condensation that accumulates in vertical condensate pan 16 eventually drains out of vertical condensate pan 16 through drain holes 17. Gasket 52B is positioned around drain holes 17 prior to positioning first cover 18 over drain holes 17 in order to help provide a substantially airtight seal between drain holes 17 and first cover 18. First cover 18 includes opening 53B, which corresponds to and is configured to fit over drain holes 17 and gasket 52B. The airtight seal helps prevent air from escaping from casing 4, and thereby increases the efficiency of evaporator assembly 2. Cap 56B may be positioned over one or more drain holes 17.

Piping system 62 fluidically connects piping 30A of first slab 6A and piping 30B of second slab 6B. Refrigerant flows through piping 32 and 30B, and is recirculated from and to a compressor through inlet and outlet tubes 20 and 22, respectively. Specifically, refrigerant is introduced into piping 30A and 30B through inlet 20 and exits piping 30A and 30B through outlet 22. As known in the art, refrigerant inlet 20 includes rubber plug 64, and refrigerant outlet 22 includes strainer 66 and rubber plug 68. Inlet 20 protrudes through opening 70 in first cover 18 and outlet 22 protrudes through opening 72 in first cover 18. By protruding through first cover 18 and out of casing 4, inlet 20 and outlet 22 may be connected to refrigerant lines that are fed from and to the compressor, respectively. Gasket 74 is positioned around inlet 20 in order to provide a substantially airtight seal around opening 70. Similarly, gasket 76 is positioned around outlet 22.

First cover 18 is attached to casing 4 with screws 78. However, in alternate embodiments, other means of attachment are used, such as welding, an adhesive, or rivets. Further covering a front face of evaporator assembly 2 is access cover 38, which is abutted with first cover 18. Again, in order to help increase the efficiency of evaporator assembly 2, it is preferred that joint 81 between first cover 18 and access cover 38 is substantially airtight. A substantially airtight connection may be formed by, for example, placing a gasket at joint 81.

Access cover 38 is attached to casing 4 with screws 82. However, in alternate embodiments, any means of removably attaching access cover 38 to casing 4 are used. Access cover 38 is preferably removably attached in order to provide access to coil 6, condensate pan 16, and other components inside casing 4 for maintenance purposes. One or more labels 84, such as warning labels, may be placed on first cover 18 and/or access cover 38.

Figure 2A:
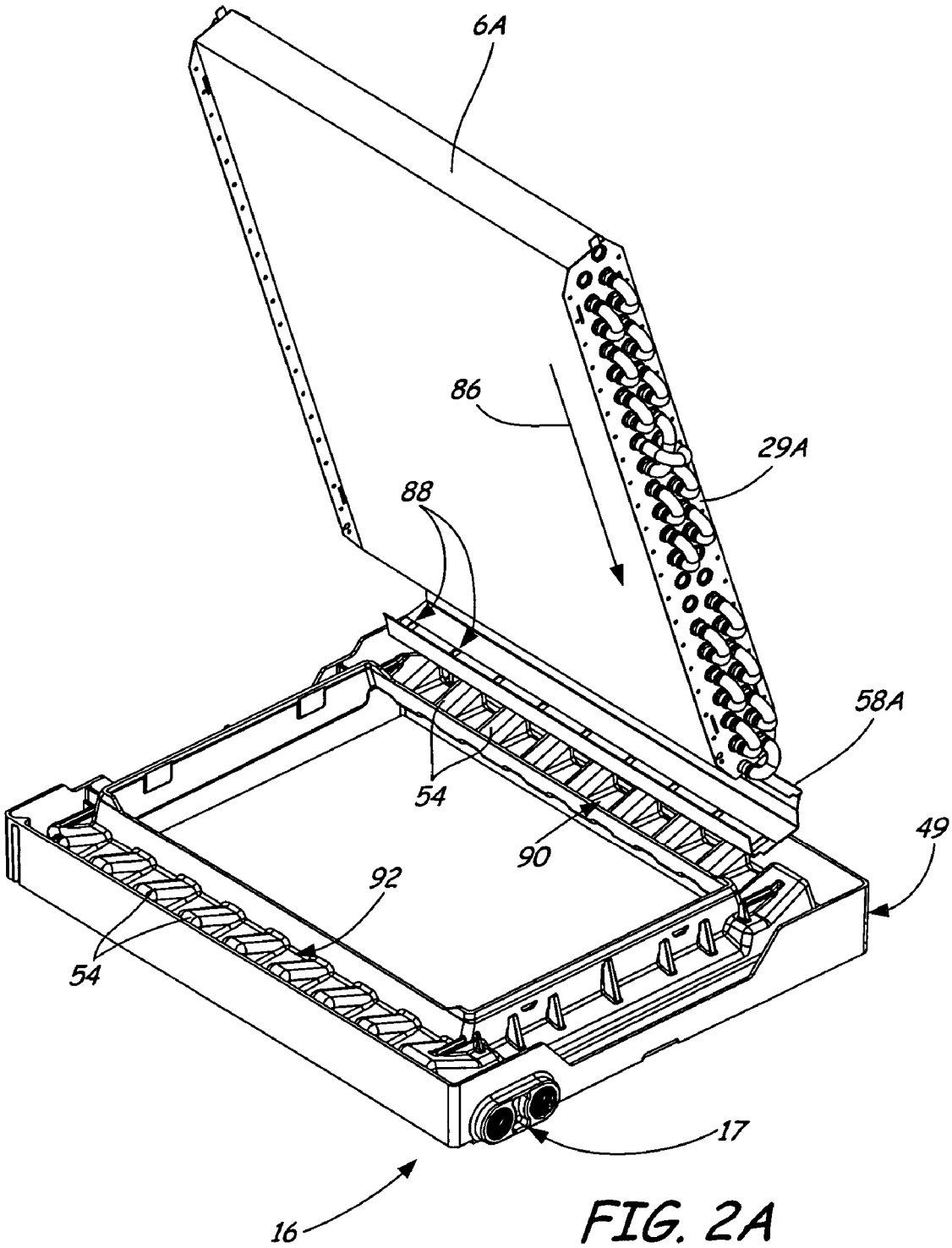
FIG. 2A is an exploded perspective view of an evaporator coil slab and the condensate pan of FIG. 1A.
Figure 2B:
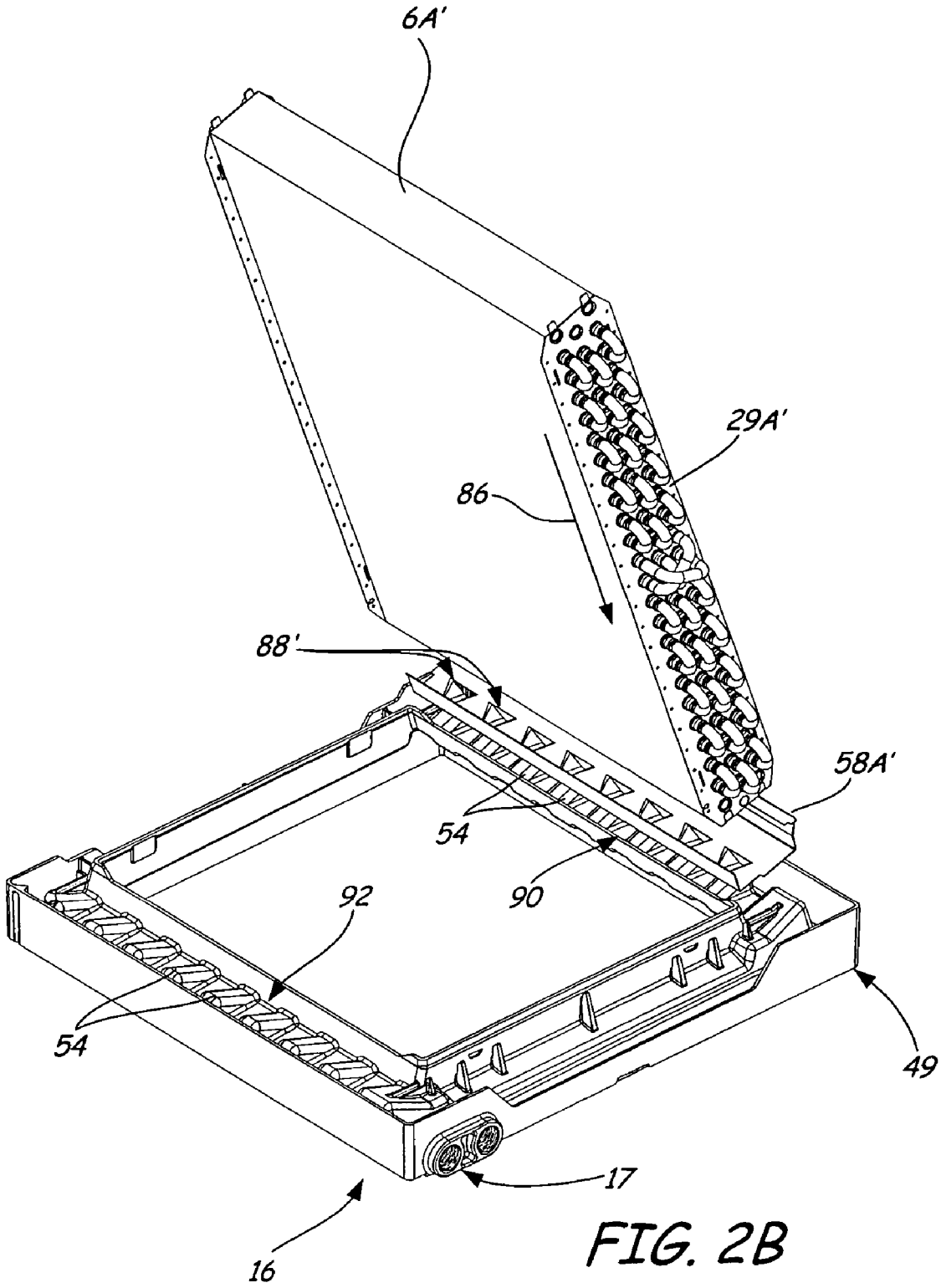
FIG. 2B is a perspective view of an alternative embodiment of an evaporator coil slab exploded from the condensate pan.

The Condensation Collection Process (FIGS. 2A and 2B)

FIG. 2A is an exploded perspective view of evaporator coil 6 and condensate pan 16 of FIG. 1A in a vertical orientation. As shown in FIG. 2A, coil slab 6B is removed for purposes of clarity and discussion. FIG. 2A also includes shield 58A and tube sheet 29A, which is attached to an edge of slab 6A. A similar tube sheet is also attached on an opposing edge of slab 6A.

When the temperature of coil slab 6A is lower than the dew point of the air moving across slab 6A, water vapor will condense on slab 6A. The condensation flows in a downward direction, due to gravity, along coil slab 6A toward shield 58A, as indicated by arrow 86. Shield 58A includes a plurality of apertures 88 aligned to be offset from a plurality of primary channels 90 disposed between ribs 54 of condensate pan 16. Apertures 88 are configured to help direct the condensation from coil slab 6A onto ribs 54 and then into primary channels 90. A similar plurality of primary channels 92 are located on an opposing side of condensate pan 16. The condensation in primary channels 90 is then directed into one of the channels along outer perimeter 49 of condensate pan 16, and eventually drained out of condensate pan 16 through drain holes 17.

In the embodiment shown in FIG. 2A, there are eight ribs 54 on each side of condensate pan 16. However, a condensate pan that includes more or less ribs is possible.

Although the above discussion focused on condensation draining from coil slab 6A, coil slab 6B is positioned within evaporator assembly 2 to allow condensation formed on slab 6B to drain in a similar manner. Thus, FIG. 2A refers to coil slab 6A merely for purposes of example.

FIG. 2B is a perspective view of an alternative embodiment of an evaporator coil exploded from condensate pan 16. As shown in FIG. 2B, coil slab 6A' has three rows of coils, and shield 58A' is configured to engage with the wider three row coil slab. However, condensation formed on coil slab 6A' is collected in condensate pan 16 in a similar manner as described above in reference to FIG. 2A. It should be understood that an evaporator coil slab having any number of coils may be incorporated into evaporator assembly 2.

Low-Sweat Condensate Pan 16 (FIGS. 3-6)

Figure 3:
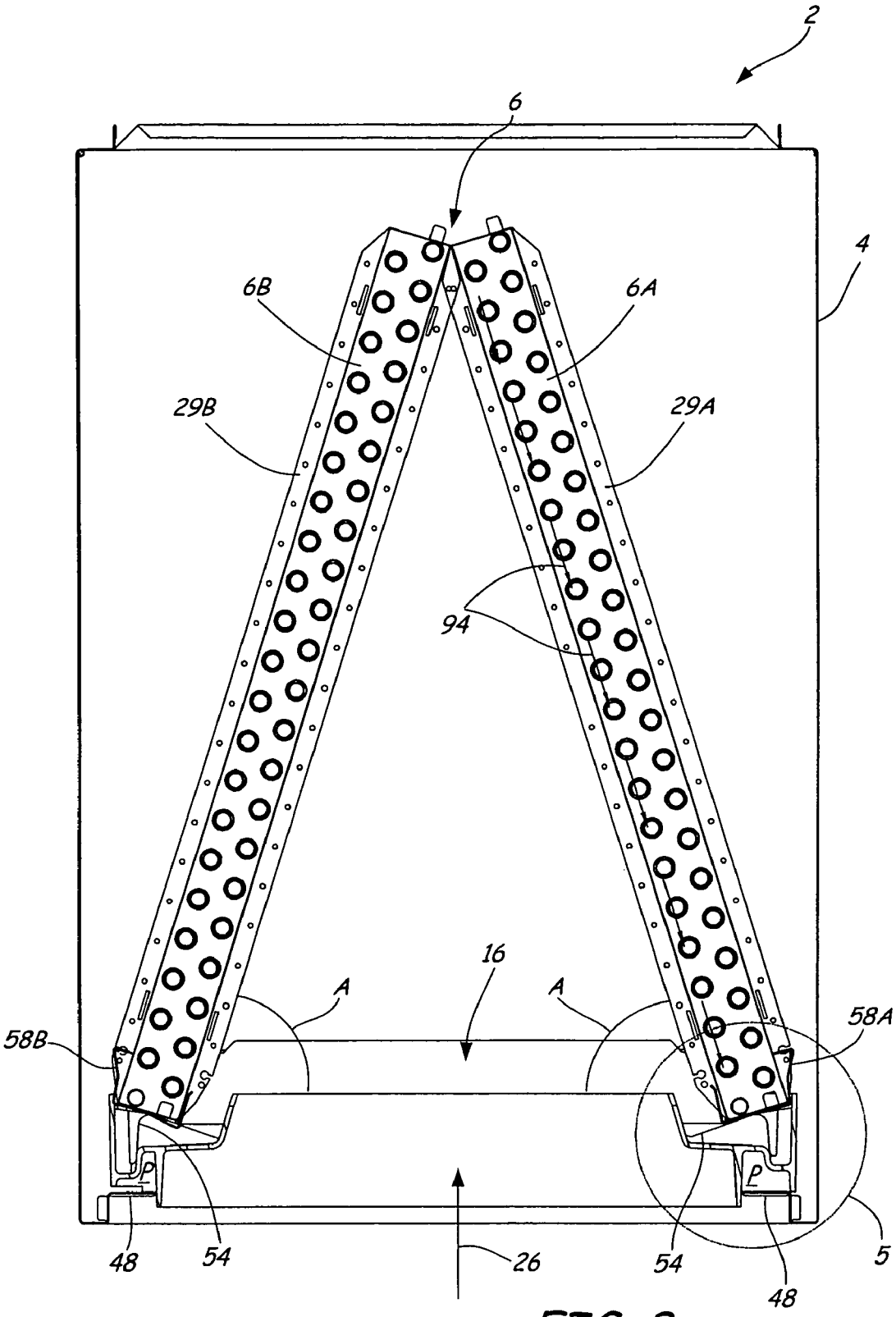
FIG. 3 is a cross-sectional view of the evaporator assembly of FIGS. 1A and 1B.

FIG. 3 is a cross-sectional view of evaporator assembly 2 showing coil 6 coupled to condensate pan 16. In FIG. 3, shield 58A is coupled to tube sheet 29A, and shield 58B (which is similar to shield 58A) is coupled to tube sheet 29B. First coil slab 6A and second coil slab 6B engage with and are supported by ribs 54 of condensate pan 16 such that slabs 6A and 6B form an angle A with condensate pan 16. The angled position of coil 6 allows condensation to drip down a side of a slab, as indicated by arrow 94 on first slab 6A. As discussed above, shields 58A and 58B are configured to catch and drain the condensation as it drips or flows down slabs 6A and 6B. Shields 58A and 58B will be discussed in more detail below, starting with reference to FIG. 7A.

Condensate pan 16 is supported by flanges 48 of casing 4. In addition to providing support for condensate pan 16, flanges 48 create an air pocket P to prevent streams of unconditioned air flowing in direction 26 (an upflow direction) from coming into contact with one or more channels located along outer perimeter 49, as will be discussed in more detail below.

Figure 4:
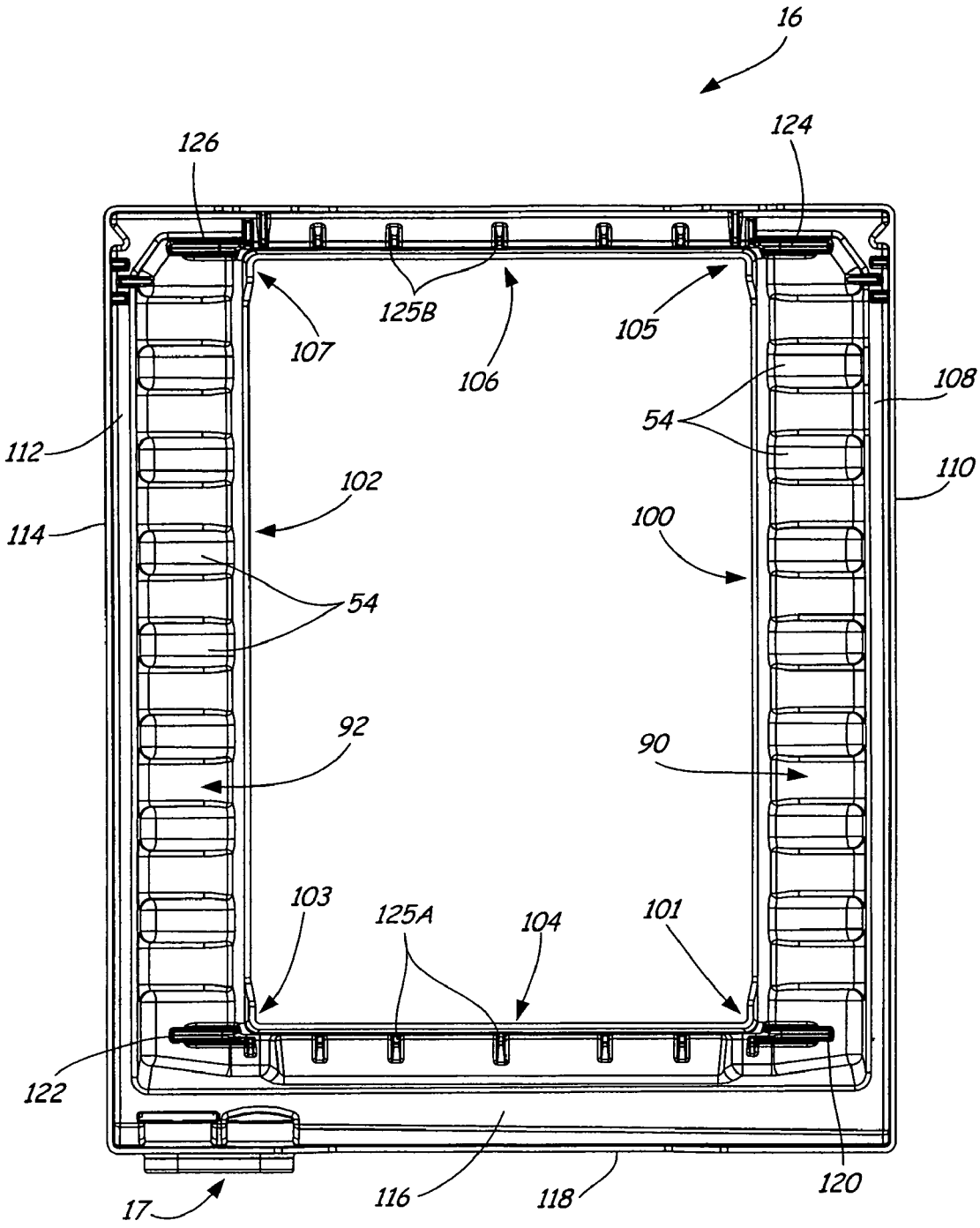
FIG. 4 is a top view of the condensate pan.

FIG. 4 is a top view of vertical condensate pan 16 shown and described above in reference to FIGS. 1A and 1B. Condensate pan 16 includes right pan member 100, left pan member 102, front pan member 104, and rear pan member 106. As shown in FIG. 4, right pan member 100 and left pan member 102 are positioned substantially parallel to each other. Furthermore, right pan member 100 and left pan member 102 are substantially perpendicular to both front pan member 104 and rear pan member 106. Thus, pan members 100-106 form a generally rectangular structure with an open center portion. In addition, right pan member 100 and front pan member 104 intersect to form first internal corner 101; left pan member 102 and front pan member 104 intersect to form second internal corner 103; right pan member 100 and rear pan member 106 intersect to form third internal corner 105; and left pan member 102 and rear pan member 106 intersect to form fourth internal corner 107.

Outer perimeter 49 of condensate pan 16 includes secondary channel 108 disposed along outer wall 110 of right pan member 100, secondary channel 112 disposed along outer wall 114 of left pan member 102, and drain channel 116 disposed along front side 118 of front pan member 104. Secondary channels 108 and 112 are configured to receive condensation from primary channels 90 and 92, respectively. Furthermore, secondary channels 108 and 112 are connected to drain channel 116, which allows condensation collected in secondary channels 108 and 112 to flow into drain channel 116 for disposal through condensate drain holes 17. To direct the flow of condensation from secondary channels 108 and 112 into drain channel 116, secondary channels 108 and 112 are sloped toward front pan member 104. As shown in FIG. 4, drain holes 17 are positioned along front side 118 of front pan member 104, although drain holes 17 may be positioned anywhere that enables condensation to exit condensate pan 16.

Although placing a secondary or drain channel in rear pan member 106 is not necessary to properly drain the condensation in evaporator assembly 2, a rear pan member may be designed to also include a channel to catch condensation from coil 6. Rear pan member 106 shown in FIG. 4 is an example of such a pan member. However, even though a rear pan member may not include a channel, it is still an important component of a condensate pan for other reasons including, but not limited to, providing rigidity to the pan and providing a surface capable of receiving and supporting a delta plate.

As shown in FIG. 4, condensate pan 16 also includes first corner groove 120, second corner groove 122, third corner groove 124, and fourth corner groove 126. First corner groove 120 and second corner groove 122 are each configured to receive a portion of delta plate 12, while third corner groove 124 and fourth corner groove 126 are each configured to receive a portion of a second delta plate similar to delta plate 12. In addition, condensate pan 16 includes a first plurality of delta plate supports 125A disposed within front pan member 104, and a second plurality of delta plate supports 125B disposed within rear pan member 106. Delta plate supports 125A and 125B help to align and provide support for their respective delta plates when inserted into condensate pan 16. Although FIG. 4 shows condensate pan 16 with five delta plate supports 125A and five delta plate supports 125B, a condensate pan with any number of delta plate supports is possible.

Typically, sweat from the cold condensation forms on an underside of a condensate pan because streams of unconditioned air being blown through an evaporator assembly are at a higher temperature than the cool condensation collected in the condensate pan. If the unconditioned air is allowed to contact a surface of the pan that contains the cool condensation (such as the secondary channels), heat will transfer from the warmer unconditioned air to the cool pan surface, causing sweat to form on the condensate pan. Thus, in order to reduce sweat from an underside of the condensate pan, condensation must be quickly re-directed away from streams of unconditioned air that are contacting the underside of the pan.

Figure 5:
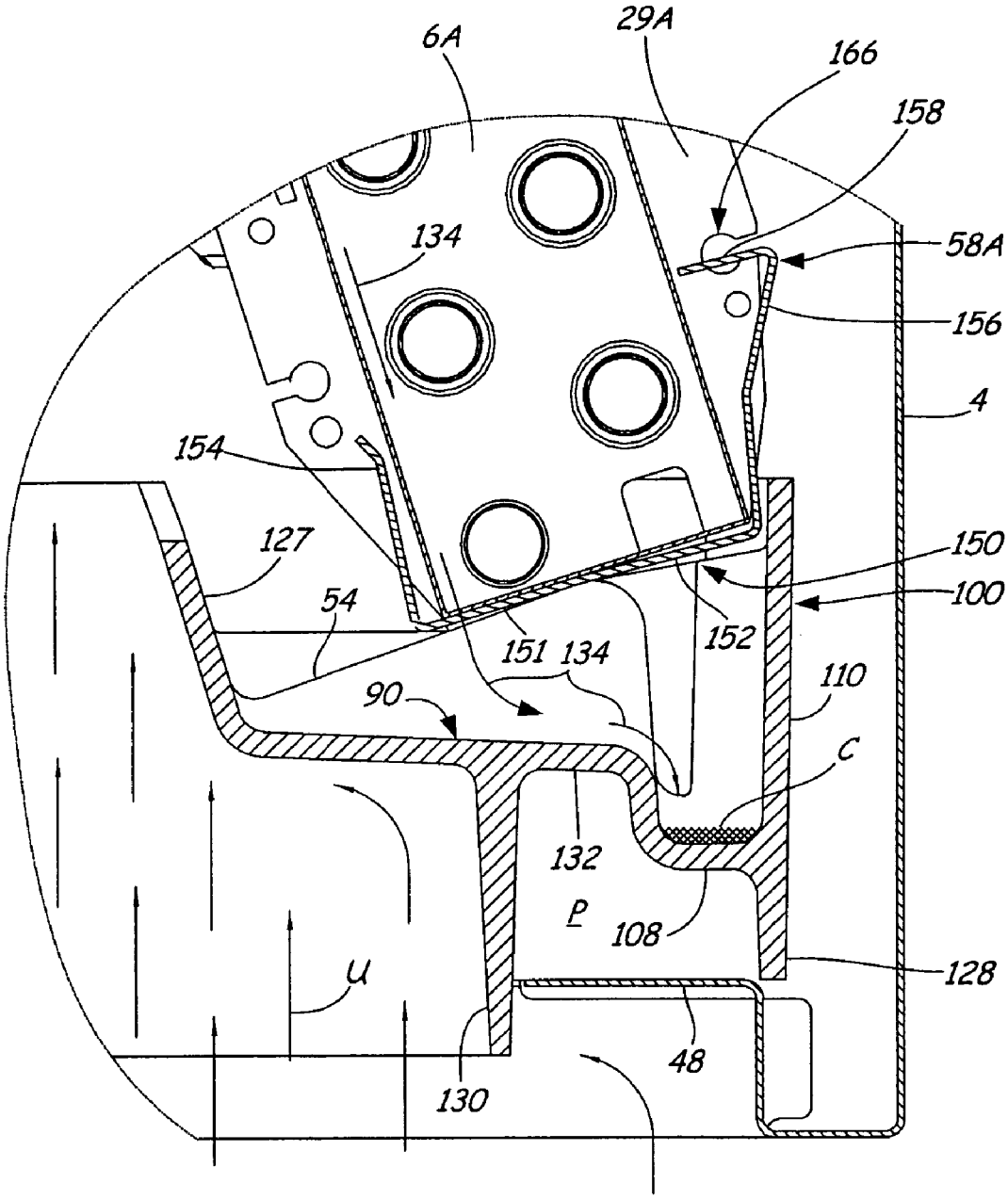
FIG. 5 is a cross-sectional view of a corner section of the evaporator assembly shown in FIG. 3.

FIG. 5 is a cross-sectional view of a corner section of the evaporator assembly shown in FIG. 3. As shown in FIG. 5, right pan member 100 further includes inner wall 127, outer air pocket wall 128, and inner air pocket wall 130. Outer air pocket wall 128 and inner air pocket wall 130 extend in a downward direction from bottom side 132 of right pan member 100 along a longitudinal length of right pan member 100. When condensate pan 16 is removed from evaporator assembly 2, such as in FIG. 1B, secondary channel 108 is open to streams of unconditioned air U. However, when properly positioned within casing 4 as shown in FIG. 5, flange 48 mates with outer air pocket wall 128 and inner air pocket wall 130 to create air pocket P. Thus, flange 48 creates a barrier between streams of unconditioned air U and secondary channel 108.

In the embodiment shown in FIG. 5, primary channels 90 are sloped toward secondary channel 108 from inner wall 127 to outer wall 110 of right pan member 100. As condensation from first coil slab 6A drips in a downward direction toward condensate pan 16, the condensation is directed into right pan member 100 by shield 58A. As discussed above in reference to FIG. 2A, the apertures in shield 58A are configured to provide a path for the condensation into primary channels 90. The sloped primary channels 90 quickly direct the condensation toward outer wall 100 and into secondary channel 108, as indicated by a condensation path depicted by arrows 134. As a result, a pool of cold condensation C is created in secondary channel 108. As discussed above in reference to FIG. 4, secondary channel 108 is sloped toward front pan member 104 to quickly direct cold condensation into drain channel 116. Furthermore, drain channel 116 is also sloped in a downward direction from right pan member 100 to left pan member 102 to direct the condensation toward drain holes 17. By providing a series of sloped channels, the condensation may be quickly removed from condensate pan 16.

The design of condensate pan 16 reduces the formation of sweat on an underside of condensate pan 16 by quickly redirecting the condensation toward secondary channel 108 along outer wall 100, and providing air pocket P between streams of unconditioned air U and the pool of cold condensation C. In particular, flange 48 of casing 4 prevents streams of unconditioned air U from reaching secondary channel 108. Air pocket P prevents (or at least slows down) the transfer of heat from the warmer streams of unconditioned air to the cooler surface of secondary channel 108 caused by cold condensation C present in channel 108. As a result of quickly directing condensation toward an outer portion of condensate pan 16 that is shielded from warm streams of unconditioned air, the formation of sweat on condensate pan 16 is reduced.

Although the above discussion in reference to FIG. 5 focused on right pan member 100, left pan member 102 includes similar features to reduce the formation of sweat on condensate pan 16. Thus, it should be understood that the discussion above applies in the same manner (except for the element numbers) to left pan member 102 as well.

Figure 6:
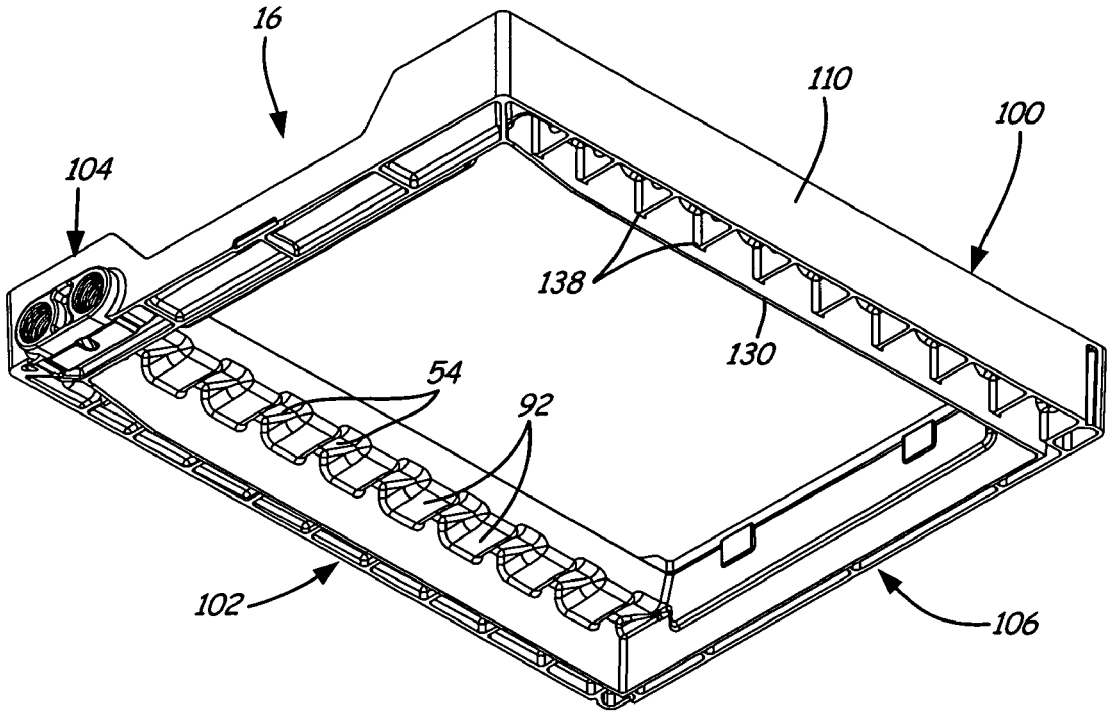
FIG. 6 is a perspective view of a bottom side of the condensate pan.

FIG. 6 is a perspective view of a bottom side of one embodiment of condensate pan 16. In the embodiment shown in FIG. 6, the bottom side of right pan member 100 further includes a plurality of support members 138 perpendicular to and extending between inner air pocket wall 130 and outer wall 110. A bottom side of left pan member 102 includes a similar plurality of support members. Support members 138 provide rigidity to right pan member 100, and are configured to mate with flange 48 in casing 4 to support condensate pan 16 and prevent a stream of unconditioned air from contacting a bottom side of secondary channel 108.

Although the above discussion has focused on a condensate pan for use with coil slabs containing two rows of coils, the condensate pan may also be used with coil slabs containing more than two rows of coils. Furthermore, although a preferred material for the construction of condensate pan 16 is a plastic, such as polyester, other materials such as metals may also be used.

Shields 58A and 58B (FIGS. 7A-13)

Shields 58A and 58B are useful in both down flow and up flow arrangements of evaporator assembly 2; however, shields 58A and 58B are of particular benefit in a down flow arrangement in which air is circulated downward (indicated by arrow 24 in FIG. 1A) from above evaporator assembly 2. Water (i.e., condensate) blow-off from coil 6 is more likely in a down flow arrangement of evaporator assembly 2. Shields 58A and 58B are configured to help address potential problems attributable to water blow-off by substantially enclosing condensation that drips off of coil 6, and directing the condensation into condensate pan 16.

Figure 7A:
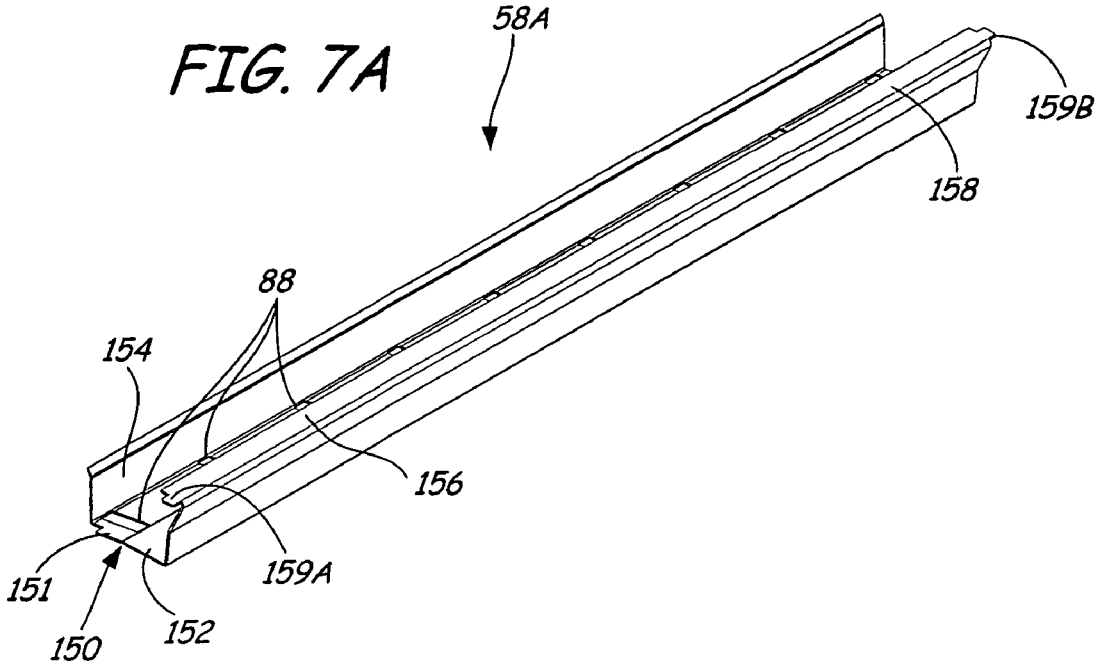
FIG. 7A is a perspective view of a shield.

FIG. 7A is a perspective view of shield 58A of FIG. 2A. Shield 58A is configured to wrap around a bottom of coil slab 6A and couple with tube sheet 29A. Shield 58A includes bottom member 150 having inside bottom portion 151 and outside bottom portion 152, inside extension member 154, and outside extension member 156. Inside bottom portion 151 includes apertures 88 described above in reference to FIG. 2A. Outside extension member 156 includes lip 158 having tabs 159A and 159B extending from opposing ends. When shield 58A is coupled to a bottom of coil slab 6A, slab 6A and shield 58A are angled such that, as the condensation drains into shield 58A, it is directed toward inside extension member 154 and drains through apertures 88.

Apertures 88 are spaced apart along inside bottom portion 151, and are configured to allow the condensation to drain through bottom member 150 of shield 58A. In the embodiment shown in FIG. 7A, apertures 88 are slots that extend across inside bottom portion 151; however, it is recognized that shield 58A could be designed with various other types of apertures or openings formed on bottom member 150 of shield 58A. As shown in FIG. 7A, shield 58A has nine apertures 88. However, shield 58A may be designed with more or less apertures.

Bottom portion 150 is configured to be positioned under a bottom end of coil slab 6A. Inside extension member 154 is configured to be positioned on an inside surface of coil slab 6A. Outside extension member 156 is configured to be positioned on an outside surface of coil slab 6A. Tabs 159A and 159B, extending from lip 158 of outside extension member 156, are configured to engage with tube sheet 29A and a similar tube sheet on an opposing edge of coil slab 6A.

Figure 7B:
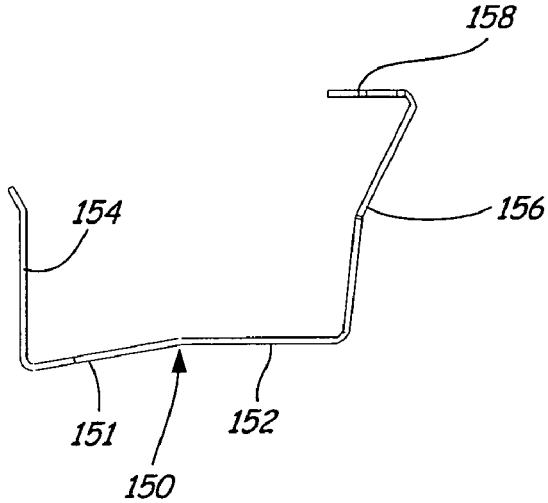
FIG. 7B is a side view of the shield of FIG. 7A.
Figure 8A:
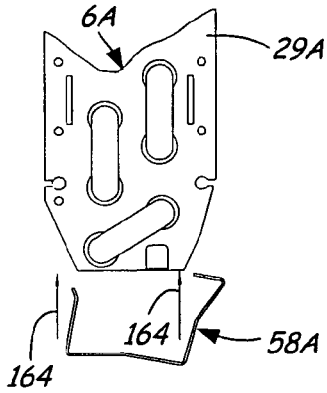
FIGS. 8A-8B illustrate a first step of attaching the shield onto a bottom of a coil slab.
Figure 8B:
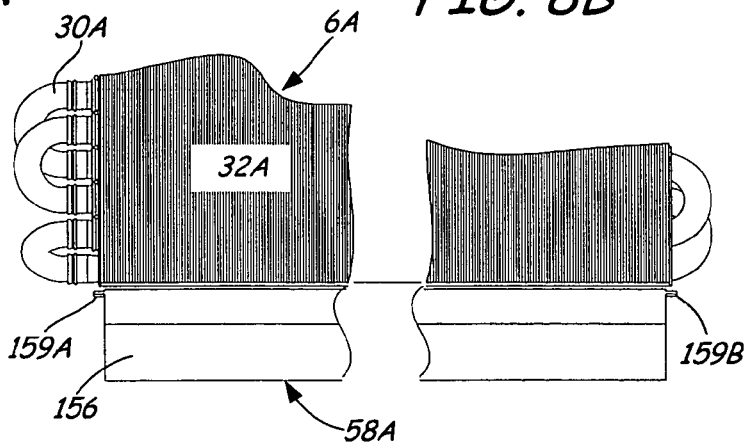

FIG. 7B is a side view of shield 58A of FIG. 7A showing bottom member 150, inside extension member 154 and outside extension member 156 including lip 158. As shown in FIG. 7B, inside bottom portion 151 is oriented at a slight angle relative to outside bottom portion 152, such that inside bottom portion 151 slopes downward toward inside extension member 154. FIGS. 8A-10B illustrate general steps in one system and method for attaching shield 58A onto a bottom of coil slab 6A. FIG. 8A shows tube sheet 29A, which is attached to an edge of coil slab 6A, and positioned above shield 58A. FIG. 8B is a rotated view of FIG. 8A showing coil slab 6A (including fins 32A and piping 30A) and shield 58A (including outside extension member 156 and tabs 159A and 159B).

Specifically, FIGS. 8A and 8B depict a first step of attaching shield 58A onto a bottom surface of coil slab 6A. As shown in FIGS. 8A and 8B, shield 58A is initially positioned below a bottom of coil slab 6A. Shield 58A is then moved upward toward coil slab 6A, as indicated by arrows 164.

Figure 9A:
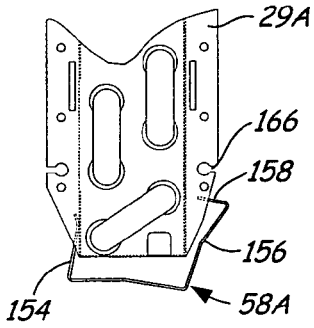
FIGS. 9A-9B illustrate a second step of attaching the shield onto the bottom of the coil slab.
Figure 9B:
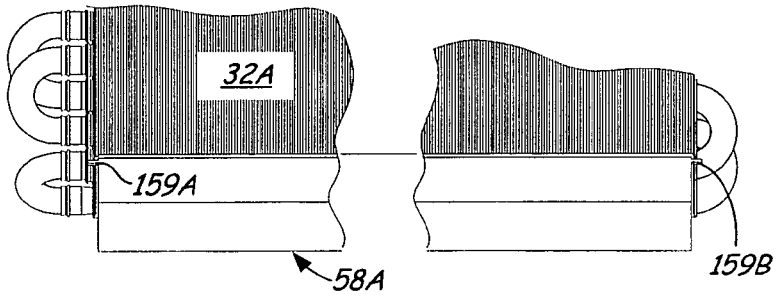

FIGS. 9A and 9B depict a second step of attaching shield 58A onto coil slab 6A. As shown in FIGS. 9A and 9B, shield 58A has moved upward such that inside extension member 154 is slid onto an inner side of coil slab 6A, and outside extension member 156 has moved upward such that lip 158 is near notch 166 on tube sheet 29A. Notch 166 on tube sheet 29A is configured to receive tab 159A extending from lip 158. A similar notch on the opposing tube sheet is similarly configured to receive tab 159B extending from the other end of lip 158.

Figure 10A:
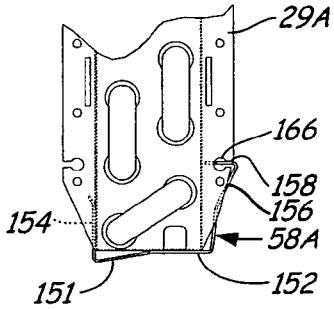
FIGS. 10A-10B illustrate a third step of attaching the shield onto the bottom of the coil slab.
Figure 10B:
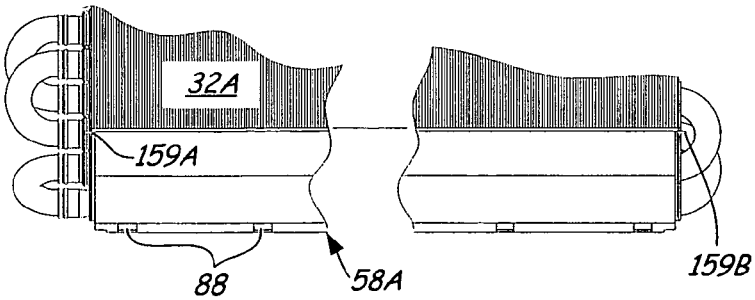

FIGS. 10A and 10B depict a third step of attaching shield 58A onto coil slab 6A. As shown in FIGS. 10A and 10B, shield 58A has been moved upward such that the bottom surface of coil slab 6A is resting on outside bottom portion 152 of shield 58A. Outside extension member 156 is positioned such that lip 158 contacts fins 32A and tab 159A of lip 158 is received through notch 166 on tube sheet 29A. Similarly, tab 159B is received through the notch on the opposing tube sheet. Inside extension member 154 is contacting a set of fins, similar to fins 32A, on the inside surface of coil slab 6A. As described above in reference to FIG. 7B, inside bottom portion 151 is angled relative to outside bottom portion 152. Thus, inside bottom portion 151 is angled relative to the bottom surface of slab 6A, as shown in FIG. 10A. As such, apertures 88 of shield 58A are visible in FIG. 10B.

Inside extension member 154 and outside extension member 156 are configured to flex during attachment onto coil slab 6A, particularly during steps two and three described above under FIGS. 9A-9B and 10A-10B. Shield 58A is designed to spring-fit onto coil slab 6A such that inside extension member 154 and outside extension member 156 open up and then spring back toward their original configuration once shield 58A is attached on coil slab 6A.

In the preferred embodiment of shield 58A described above, shield 58A is attachable to coil slab 6A without requiring any fasteners. However, it is recognized that shield 58A and coil slab 6A may be designed to incorporate other suitable means of attaching shield 58A to coil slab 6A using, for example, screws, rivets or other types of fasteners.

Referring back to FIG. 5, coil slab 6A and shield 58A are shown coupled to condensate pan 16. As explained above in reference to FIG. 3, coil slab 6A and shield 58A are supported by ribs 54 of condensate pan 16 such that coil slab 6A and shield 58A are oriented at an angle relative to condensate pan 16. As explained above in reference to FIG. 2A, apertures 88 on inside bottom portion 151 of shield 58A are aligned with ribs 54 of condensate pan 16. In FIG. 5, bottom member 150 is substantially flat, despite inside bottom portion 151 being originally configured at a slight angle relative to outside bottom portion 152, as shown in FIG. 7B. When coil slab 6A and shield 58A are coupled to pan 16, inside bottom portion 151 is brought closer into alignment with outside bottom portion 152 due to contact with ribs 54.

Due to the angle of coil slab 6A and shield 58A relative to condensate pan 16, as the condensation drips down slab 6A and into shield 58A, the condensation is directed toward inside extension member 154 and then through apertures 88. After the condensation drains through apertures 88 of inside bottom portion 151, the condensation flows onto ribs 54 and into primary channels 90. Primary channels 90 are sloped downward such that the condensation will automatically flow into secondary channel 108 disposed along outer wall 110 of right pan member 100.

Shield 58A is typically formed from a thin, single sheet of metal. In one embodiment, shield 58A is made from aluminum to prevent corrosion. However, other materials may be used without diminishing the functionality of shield 58A.

Shield 58B, shown in FIG. 3, is similar to shield 58A and is attachable to second coil slab 6B in a similar manner to how shield 58A is attachable to coil slab 6A. Shield 58B is configured to drain condensation from second coil slab 6B into primary channels 92 on an opposing side of condensate pan 16 (see FIG. 4).

Figure 11A:
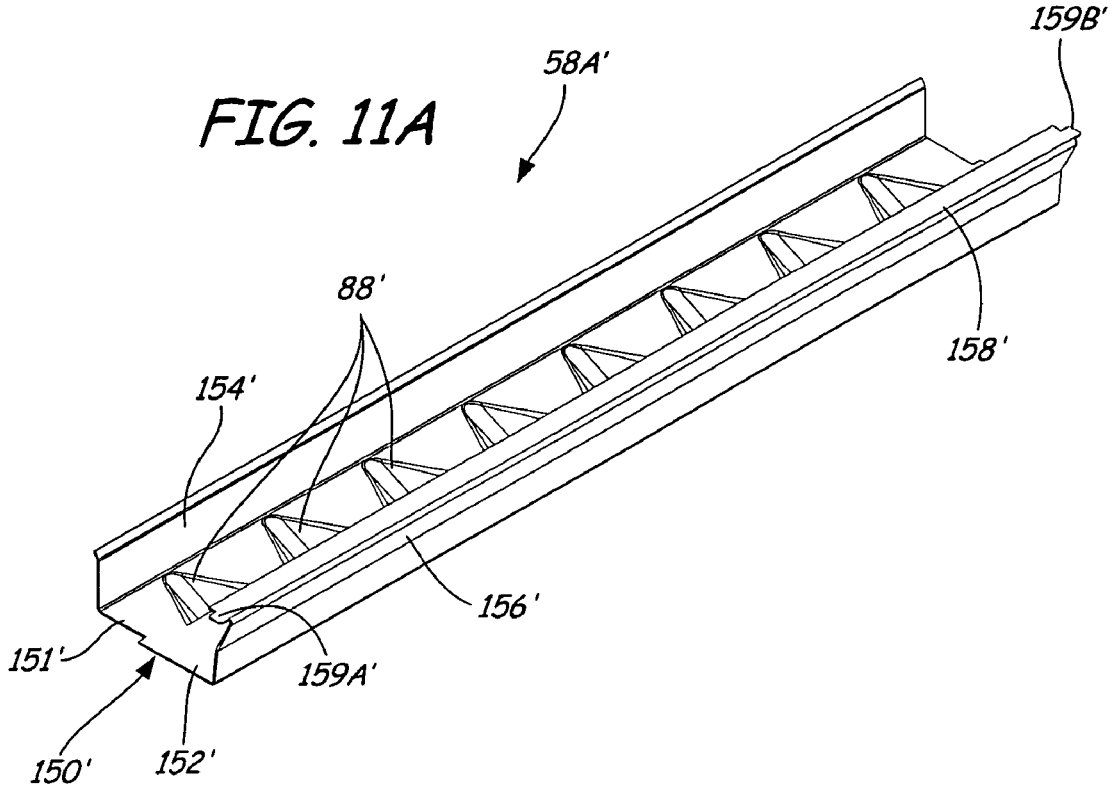
FIG. 11A is a perspective view of an alternative embodiment of a shield.

FIG. 11A is a perspective view of shield 58A', which is an alternative embodiment of shield 58A of FIG. 7A. Shield 58A' is shown in FIG. 2B and is configured to engage with coil slab 6A' which is a wider three row coil slab. Shield 58A' similarly includes bottom member 150' having inside bottom portion 151' and outside bottom portion 152', inside extension member 154', and outside extension member 156'. Lip 158' is connected to outside extension member 156' and includes tabs 159A' and 159B' extending from opposing ends.

Similar to shield 58A, bottom member 150' of shield 58A' includes apertures 88'. Apertures 88' are spaced apart along inside bottom portion 151' and each aperture 88' extends across inside bottom portion 151'. However, in shield 58A', a different type of aperture is used, as compared to shield 58A, to direct the condensation toward inside extension member 154' and then out through bottom member 150'.

In this embodiment, apertures 88' formed on inside bottom portion 151' of shield 58A' comprise a plurality of shield channels. As shown in FIG. 2B, when shield 58A' is assembled on coil slab 6A', the shield channels are aligned with primary channels 90 of condensate pan 16 and are configured to drain the condensation out of shield 58A' and into condensate pan 16. It should be understood that shield channels are merely one example of an aperture design that may be used to direct condensation from a coil slab into a condensate pan. Moreover, shield 58A' of FIG. 11A is shown with eight shield channels formed on inside bottom portion 151; however, it is recognized that more or less shield channels may incorporated into shield 58A'.

Figure 11B:
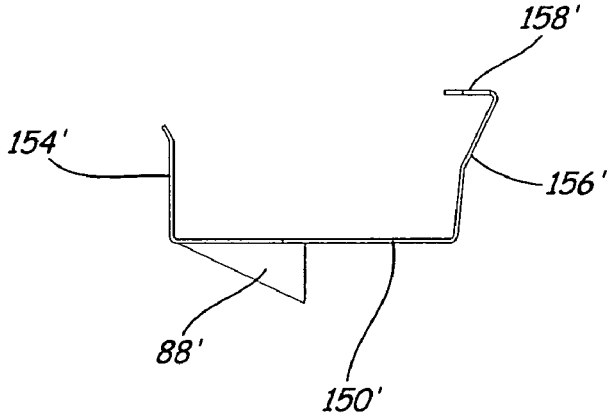
FIG. 11B is a side view of the shield of FIG. 11A.

FIG. 11B is a side view of shield 58A' of FIG. 11A showing bottom member 150', inside extension member 154', outside extension member 156', and lip 158'. As described above, apertures 88' are shield channels and are configured to extend below bottom member 150'.

Figure 12A:
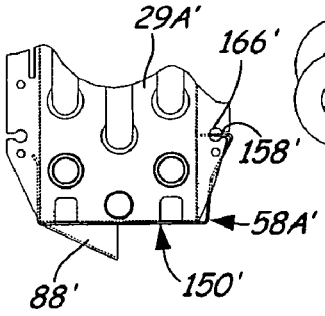
FIGS. 12A-12B show the shield of FIG. 11A attached onto a bottom of a coil slab.
Figure 12B:
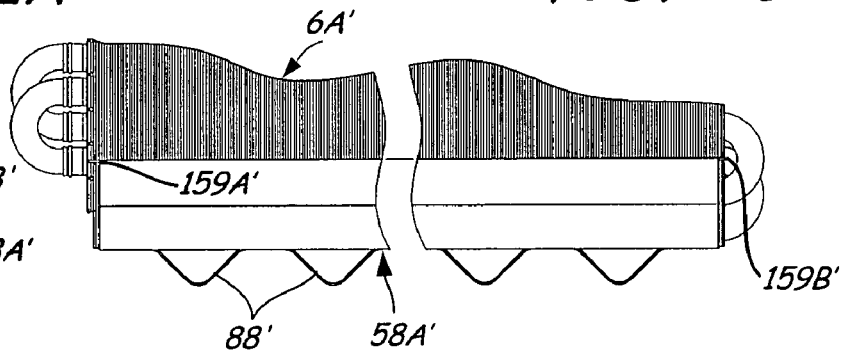

FIGS. 12A and 12B show shield 58A' attached onto a bottom surface of coil slab 6A'. Shield 58A' is attached onto coil slab 6A' in a similar manner as described above under FIGS. 8A-10B in reference to attachment of shield 58A onto coil slab 6A.

Figure 13:
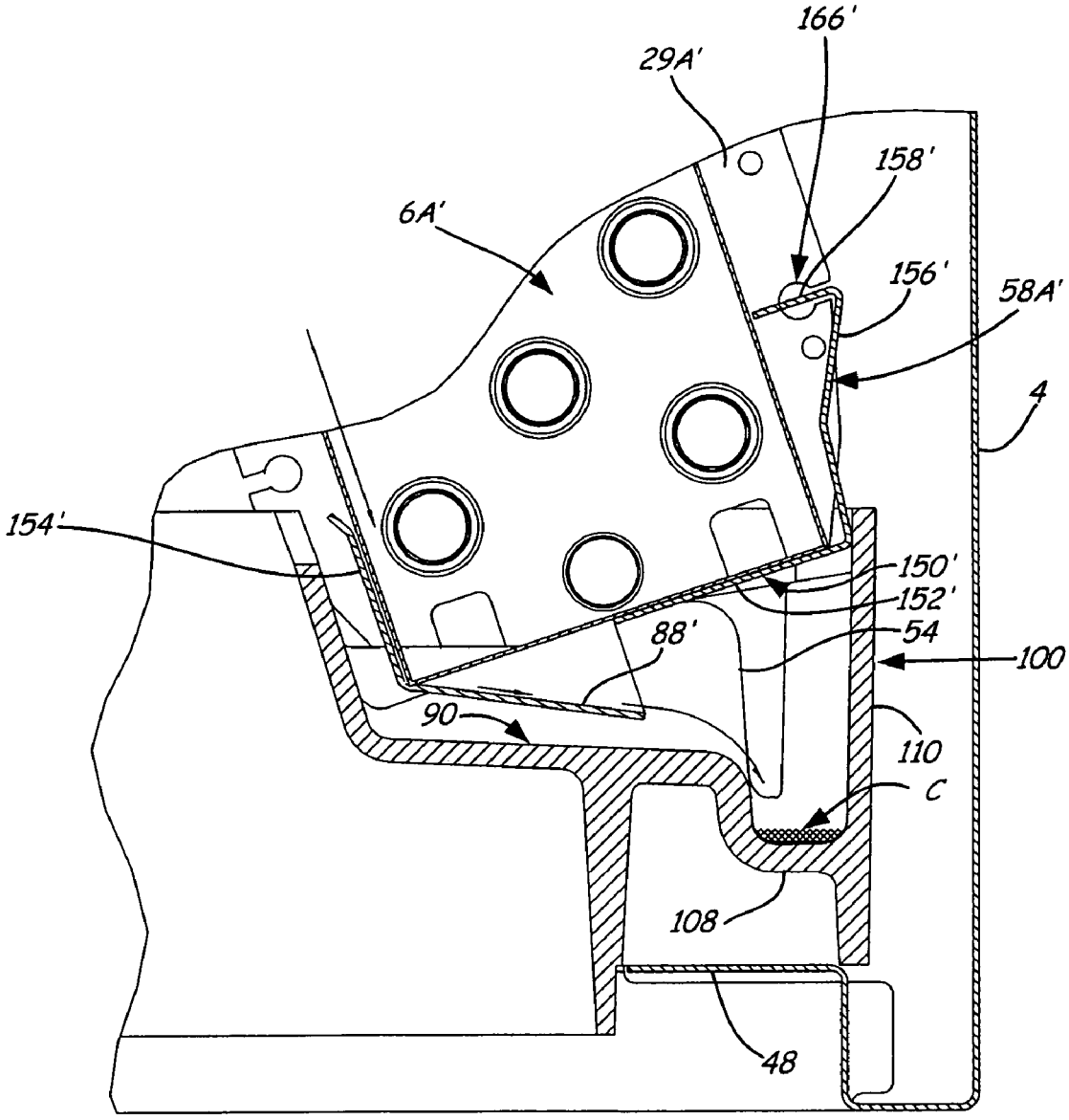
FIG. 13 is a cross-sectional view of the shield of FIG. 11A attached to a coil slab having three rows of coils.

As shown in FIGS. 12A and 12B, tab 159A' on lip 158' is inserted through notch 166' on tube sheet 29A'. Tab 159B' is inserted through a similar notch on an opposing tube sheet. When shield 58A' is attached on coil slab 6A, a bottom surface of coil slab 6A' rests on bottom portion 150'. Apertures 88' are configured to extend below bottom member 150' of shield 58A'. FIG. 13 is a cross-sectional view of shield 58A' of FIG. 11A attached to coil slab 6A' and coupled to condensate pan 16. Again, shield 58A' is configured such that the condensation that drains into shield 58A' is directed toward inside extension portion 154' and then through apertures 88'. Apertures 88' are aligned with primary channels 90 of condensate pan 16 such that the condensation drains through apertures 88' into primary channels 90. The condensation is then drained out of condensate pan 16 in the same manner as described above.

A shield similar to shield 58A' is attachable to a second coil slab of evaporator assembly 2 in a similar manner.

In the preferred embodiments described above, shield 58A is configured to be attached to a coil slab with two rows of coils, and shield 58A' is configured to be attached to a coil slab with three rows of coils. Moreover, apertures 88 of shield 58A are described as being configured to align with ribs 54 of condensate pan 16, whereas apertures 88' of shield 58A' are described as being configured to align with primary channels 90 of condensate pan 16. However, it is recognized that either embodiment of shields 58A and 58A' could be used with a coil having any suitable number of rows. Similarly, either shield design could be configured to align with either ribs 54 or primary channels 90 of condensate pan 16. Additionally, the shields described above are configured to be used with multiple coil sizes.

Figure 14:
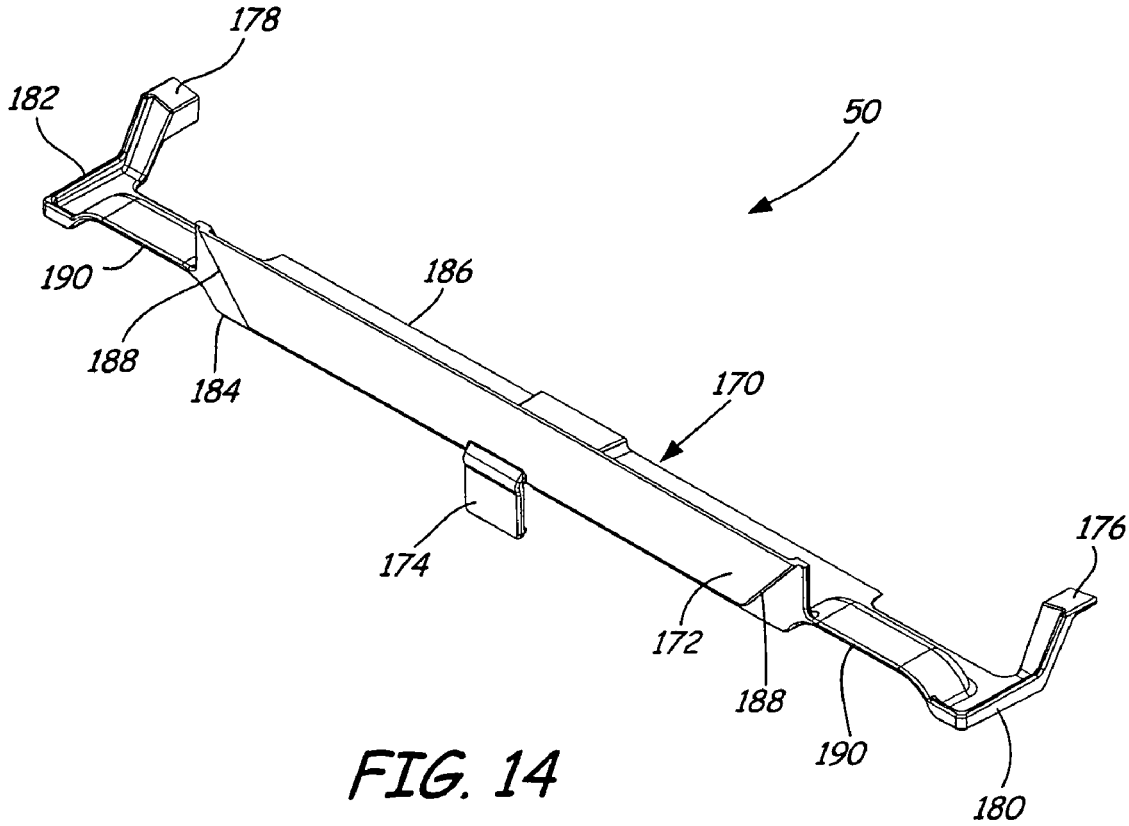
FIG. 14 is a perspective view of a condensate pan insert for the evaporator assembly.
Figure 15A:
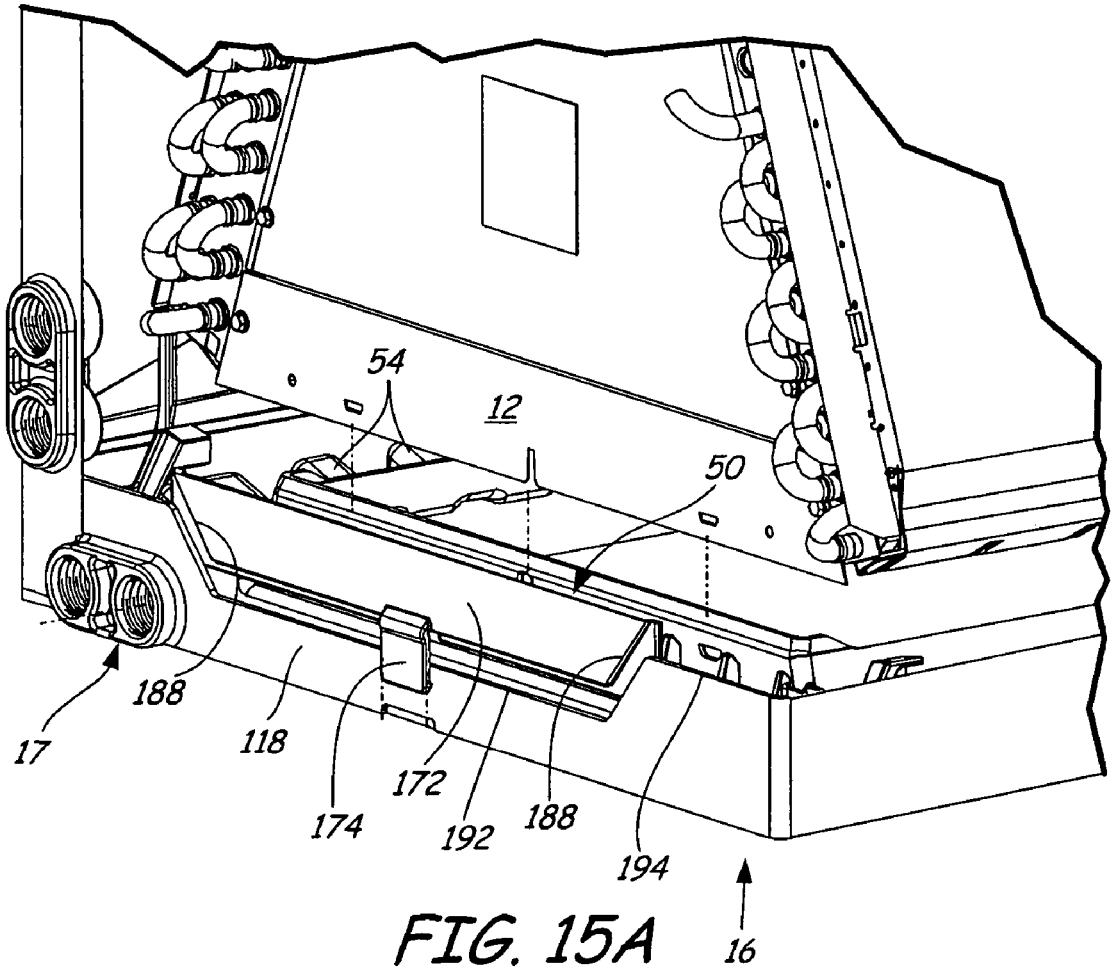
FIG. 15A is an enlarged perspective view of the evaporator assembly showing the condensate pan and pan insert.
Figure 15B:
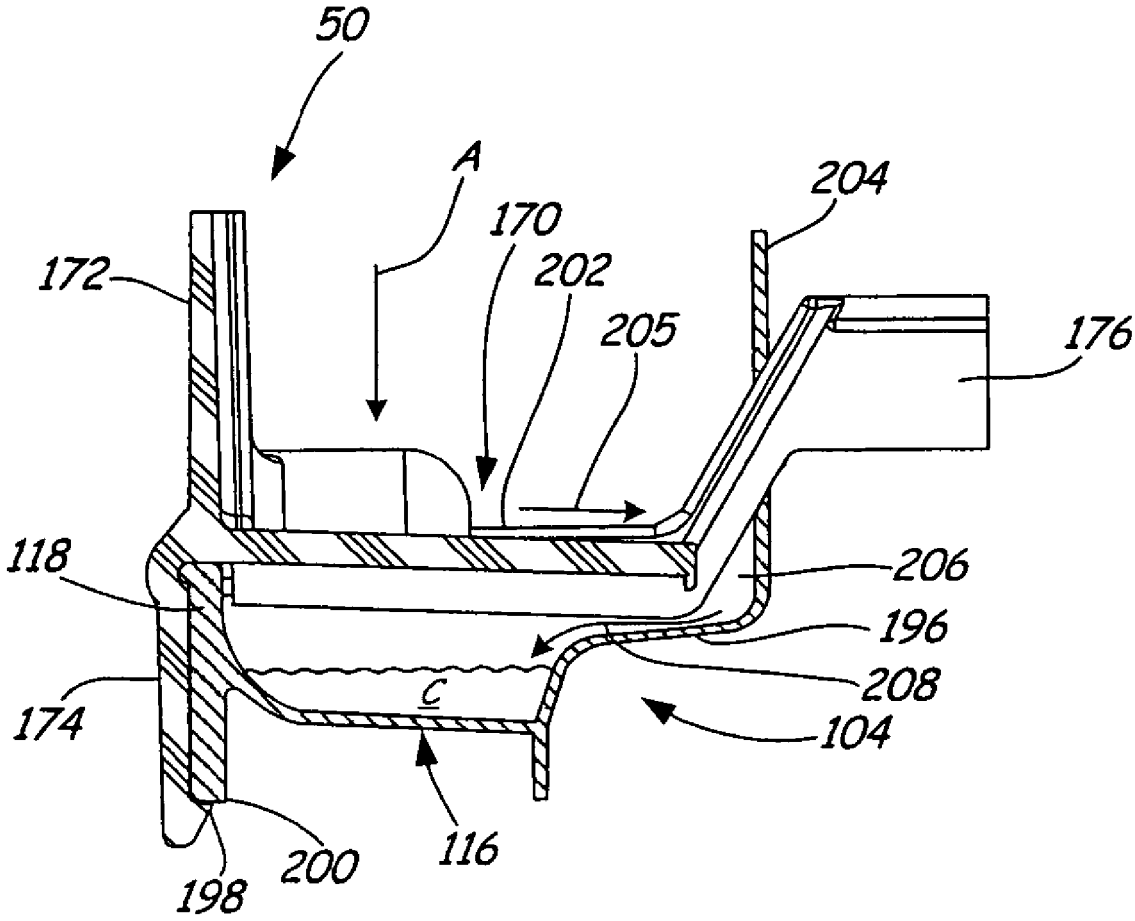
FIG. 15B is a sectional view showing the condensate pan insert secured to a front pan member of the condensate pan.

Condensate Pan Insert 50 (FIGS. 14, 15A, and 15B)

FIG. 14 is a perspective view of a representative embodiment of condensate pan insert 50, which includes cover member 170, pan wall member 172, snap member 174, first wing member 176, and second wing member 178. Cover member 170 has first end 180, second end 182, front side 184, and rear side 186. As shown in FIG. 14, pan wall member 172 is positioned at front side 184, first wing member 176 is positioned at first end 180, and second wing member 178 is positioned at second end 182 of cover member 170.

When inserted into condensate pan 16 as shown in FIG. 1B, condensate pan insert 50 is configured to cover an open top of drain channel 116, thereby enclosing drain channel 116 to prevent a stream of air from contacting the condensation collected in condensate pan 16. Without condensate pan insert 50 positioned within condensate pan 16, evaporator assembly 2 is more susceptible to condensation blow-off. Condensation blow-off occurs when condensation that is collected in condensate pan 16 is blown into the air stream moving through evaporator assembly 2. As a result, condensation may be blown into the furnace or surrounding ductwork, potentially leading to problems such as moisture build-up or mold.

Although FIGS. 1A and 1B depict evaporator assembly 2 having coil 6 with only two rows of coils, condensate pan insert 50 is particularly useful in an embodiment where coil 6 has three or more rows of coils. In general, when evaporator assembly 2 is operating in a down flow application, a larger number of coil rows correlates with a larger velocity of a stream of air circulated by the blower in the downward direction (as indicated by arrow 24 in FIG. 1A). As a result of the increased velocity, there is a greater chance that the stream of air will hit drain channel 116 and prevent accumulated condensation from flowing properly from secondary channels 108 and 112 into drain channel 116, thereby leading to condensation blow-off.

A first air gap is formed between first coil slab 6A and secondary channel 108 when evaporator assembly 2 is fully assembled. Similarly, a second air gap is formed between second coil slab 6B and secondary channel 112 when evaporator assembly 2 is fully assembled. When condensate pan insert 50 is properly secured to front pan member 104, first wing member 176 and second wing member 178 are configured to be inserted into the first and second air gaps, respectively. Once inserted into the air gaps, first wing member 176 and second wing member 178 function with cover member 170 to prevent a stream of air from entering secondary channel 108, secondary channel 112, or drain channel 116 during a down flow application of evaporator system 2. Thus, in the embodiment shown in FIG. 14, first wing member 176 and second wing member 178 act together with cover member 170 to prevent condensation blow-off during a down flow application of evaporator system 2.

In other embodiments of evaporator system 2, the coil slabs and the secondary channels may couple with each other in such a way that the first and second air gaps are eliminated, thereby preventing a stream of air from entering the secondary channels without the need for the wing members. Therefore, in such embodiments, first wing member 176 and second wing member 178 are not a necessary part of condensate pan insert 50.

As shown in FIG. 15A, front side 118 of front pan member 104 includes a recess 192 along a top edge 194. When properly secured to front pan member 104 of condensate pan 16, pan wall member 172 mates with recess 192 in front pan member 104 to form a portion of front side 118. In particular, angled contour 188 of pan wall member 172 mates with an angled contour of recess 192 to create a substantially smooth and continuous top edge 194 on front side 118 of front pan member 104.

Furthermore, condensate pan insert 50 may include one or more raised arch portions 190 as shown in FIG. 14. In some embodiments of condensate pan 16, drain holes 17 may extend higher (closer toward top edge 194 of front pan member 104) along front side 118 than drain channel 116. As a result, a portion of drain holes 17 would not be protected by cover member 170 of condensate pan insert 50. Thus, raised arch portions 190 are positioned along front side 184 of cover member 170 and are configured to receive and provide a cover for drain holes 17.

FIG. 15B is a side view of condensate pan insert 50 secured to front pan member 104. As shown in FIG. 15B, when properly positioned within condensate pan 16, cover member 170 extends between front side 118 and surface 196 of front pan member 104 to enclose an otherwise open side of drain channel 116. Condensate pan insert 50 thus forms a barrier between a stream of air A above cover member 170 and condensation C collected in drain channel 116 below cover member 170.

Snap member 174 further comprises lip 198 that engages with bottom edge 200 of front side 118 to secure condensate pan insert 50 to front pan member 104. Lip 198 ensures that condensate pan insert 50 remains securely fastened to front pan member 104 during shipment and operation of evaporator assembly 2. In other embodiments, lip 198 engages with another feature of front side 118 other than bottom edge 200. For example, front pan member 104 may include a slot configured to receive lip 198 to securely fasten condensate pan insert 50 to condensate pan 16. Other means of attachment are also available for securing condensate pan insert 50 to condensate pan 16.

Cover member 170 of condensate pan insert 50 may include top surface 202 that is sloped in a downward direction between front side 118 and rear side 204 of front pan member 104. A sloped top surface 202 directs condensation that drips onto cover member 170 during the operation of evaporator assembly 2 (such as from blow-off as discussed above) toward rear side 204 of front pan member 104, as indicated by arrow 205. Additionally, cover member 170 may be designed such that when cover member 170 engages with surface 196 of front pan member 104, gap 206 is formed. Gap 206 allows condensation that dripped onto cover member 170 and was directed toward rear side 204 (as shown by arrow 205) to be re-directed onto surface 196, which may be sloped in a downward direction toward drain channel 116. As a result, the condensation eventually flows into drain channel 116, as indicated by arrow 208. Although sloped top surface 202 and gap 206 are not a necessary component of condensate pan insert 50, they provide an additional benefit that increases the effectiveness of the insert. For instance, in an embodiment that does not incorporate sloped top surface 202 and gap 206, condensation that drips onto cover member 170 may end up being blown into the furnace or duct-work, resulting in problems such as those previously discussed.

A preferred material for manufacturing condensate pan insert 50 is a plastic, such as polycarbonate. However, condensate pan insert 50 may be formed from other materials, such as various types of metal including sheet metal or aluminum. In addition, condensate pan insert 50 is preferably injection molded to form a single part. Alternatively, the various components of condensate pan insert 50 (such as right pan member 100, left pan member 102, front pan member 104, and rear pan member 106) may be formed as separate parts and secured together by means such as welding or gluing.

Figure 16:
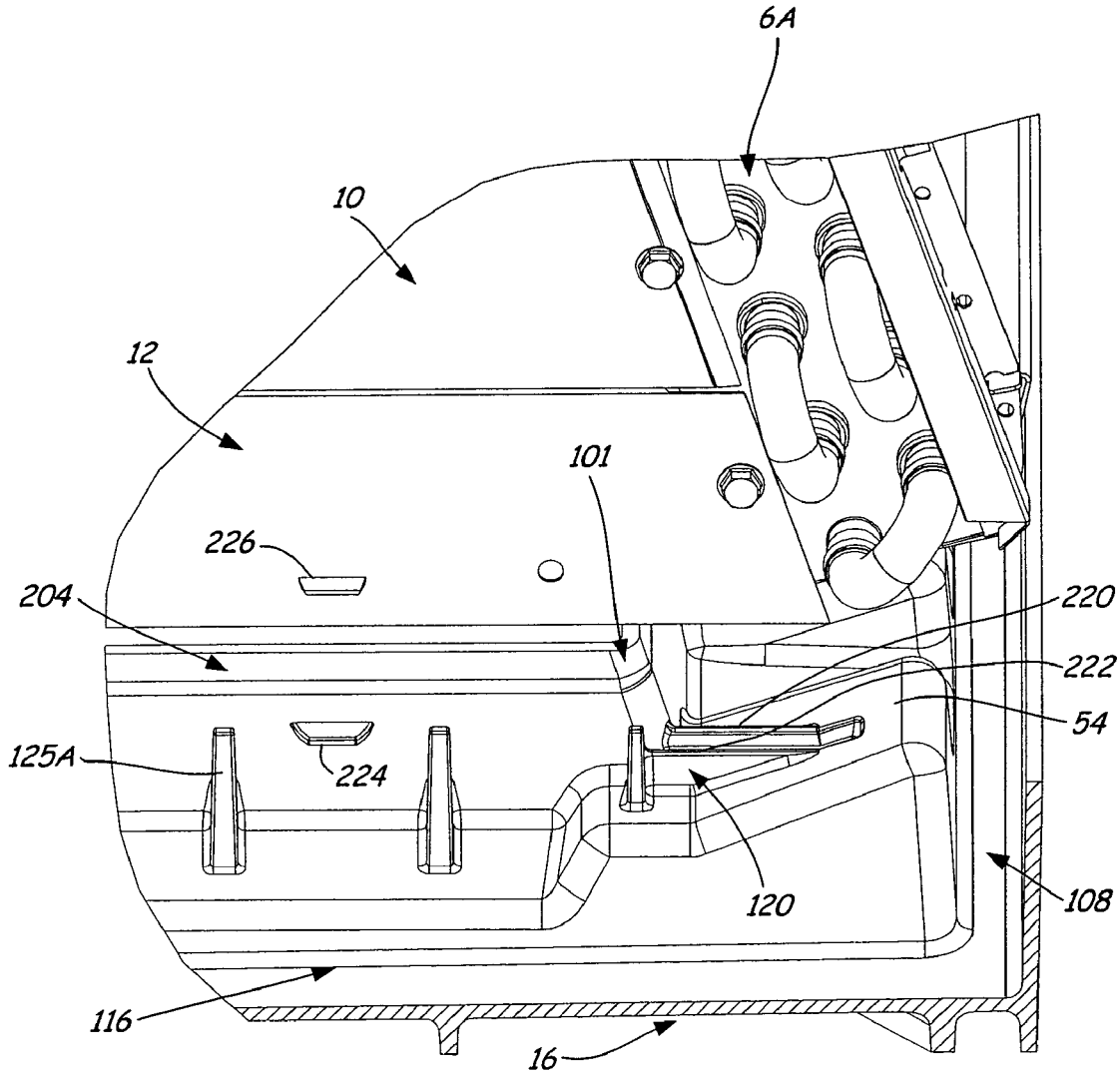
FIG. 16 is a perspective view of a corner section of the evaporator assembly showing a delta plate prior to insertion into a first corner groove of the condensate pan.
Figure 17:
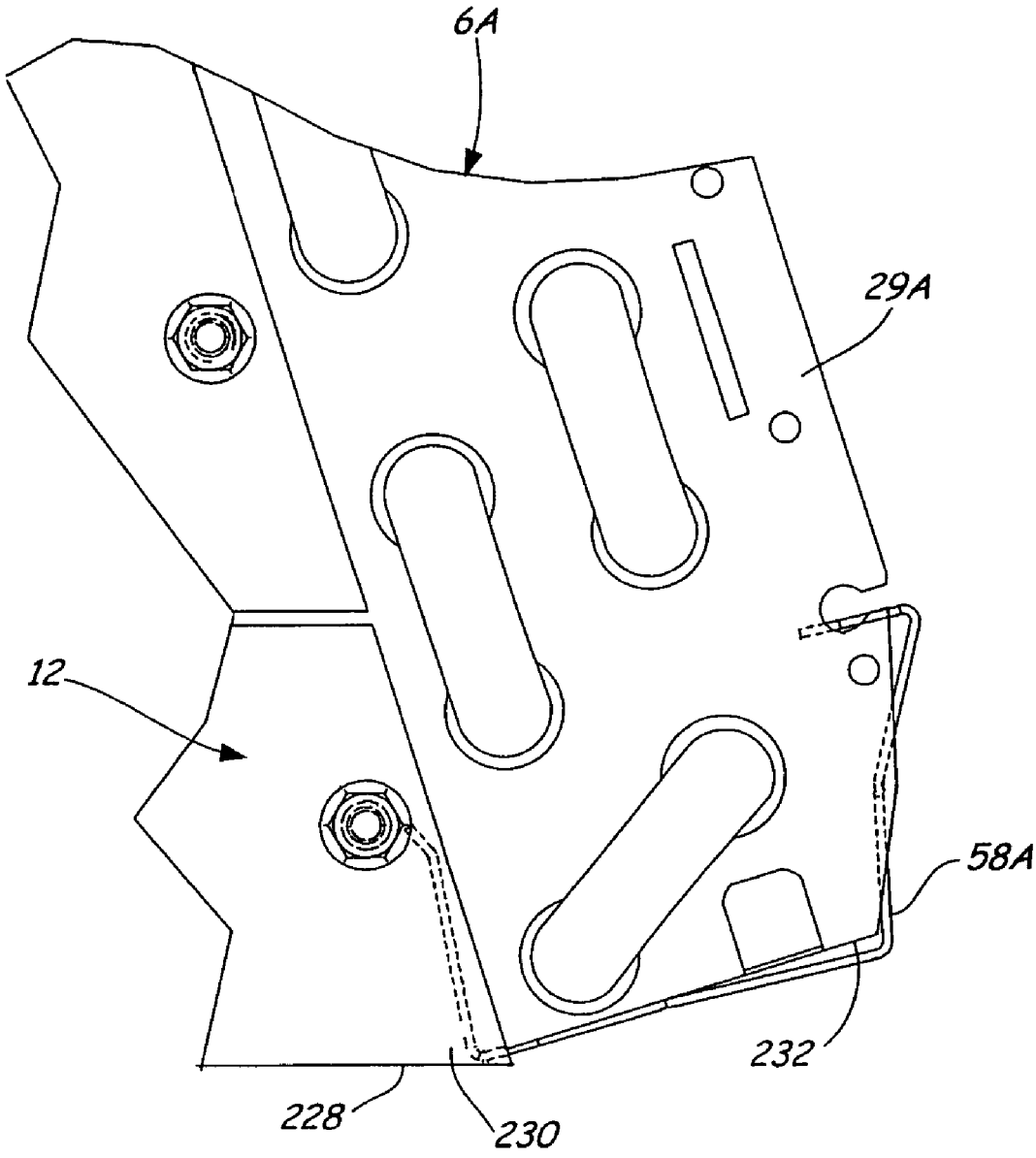
FIG. 17 is a side view of a corner portion of the delta plate coupled to a coil slab.
Figure 18:
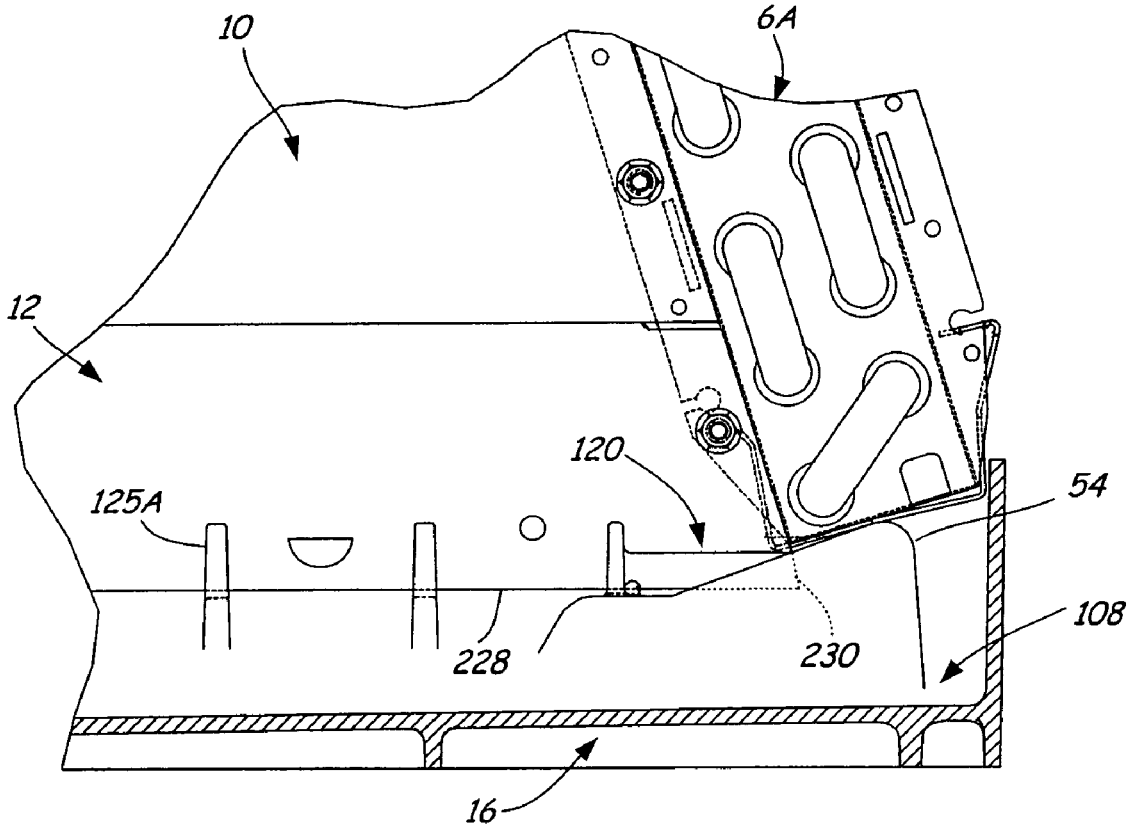
FIG. 18 is a side view of the corner section of the evaporator assembly shown and described above in reference to FIG. 16 after the delta plate has been inserted into the first corner groove.

Internal Corner Feature of Condensate Pan 16 (FIGS. 16-18)

In typical evaporator assemblies, a gap is formed on the four internal corners of the condensate pan where the delta plate and the coil slab engage with the condensate pan. These gaps are generally due to round radii on the internal corners of the condensate pan to improve strength. In down flow applications, streams of high velocity air pass by the gap, with some of these high velocity streams entering the gap. This poses a problem because the air streams may get in between the coil slab and the condensate pan. As a result, condensation on the coil slab or condensate pan may get caught-up in the streams of high velocity air between the slab and the pan and end up being blown-off of those surfaces. Condensation blow-off due to high velocity air entering these gaps is undesirable because the condensation that is blown-off of the coil slab or condensate pan cannot be controlled, and as a result, it may be carried into the furnace or duct-work by the air streams. Among other things, blown-off condensation may harm the furnace components or result in moisture build-up or mold formation in the furnace or duct-work. The design of condensate pan 16 reduces condensation blow-off by placing a corner groove member in each of the internal pan corners in order to eliminate the gap and prevent streams of high velocity air from getting in between the coil slab and condensate pan.

FIG. 16 is a perspective view of a corner section of evaporator assembly 2 showing delta plate 12 prior to insertion into first corner groove 120. First corner groove 120 includes first rib 220 and second rib 222. First rib 220 and second rib 222 are spaced apart and configured to receive delta plate 12. As shown in FIG. 16, first corner groove 120 forms a portion of one of ribs 54 near first internal corner 101. Once evaporator assembly 2 is assembled as shown in FIG. 1A, a portion of delta plate 12 will be positioned within first corner groove 120, thereby preventing the formation of a gap near first internal corner 101.

As shown in FIG. 16, condensate pan 16 includes aperture 224 configured to receive tab 226 of delta plate 12. Tab 226 of delta plate 12 is configured to be inserted into aperture 224 to secure delta plate 12 to condensate pan 16. Delta plate supports 125A are configured to align delta plate 12 within condensate pan 16 and provide support so that tab 226 is not inadvertently removed from aperture 224. Furthermore, delta plate supports 125A may be configured to support delta plate 12 so that an inner surface of delta plate 12 remains substantially flush with inner wall 204.

Although FIG. 16 focuses on first corner groove 120, the other corner grooves of condensate pan 16 also include a pair of ribs spaced apart and configured to receive a portion of a delta plate to reduce condensation blow-off. For instance, third corner groove 124 and fourth corner groove 126 each include a pair of ribs configured to receive a delta plate similar to delta plate 12. In a preferred embodiment, all of the corner grooves are constructed from the same material as condensate pan 16. However, in the alternative, other materials may be used to create corner grooves 120-126.

FIG. 17 is a side view of a corner portion of delta plate 12 and coil slab 6A. Delta plate 12 further includes bottom edge 228 and corner 230. As shown in FIG. 17, bottom edge 228 of delta plate 12 extends below a bottom edge 232 of coil slab 6A. Positioning bottom edge 228 below coil slab 6A allows corner 230 and a portion of bottom edge 228 to be inserted into first corner groove 120 between first rib 220 and second rib 222, as will be shown in the following figure.

FIG. 18 is a side view of the corner section of evaporator assembly 2 shown and described above in reference to FIG. 16. As shown in FIG. 18, coil 6 has been coupled to condensate pan 16 such that coil slab 6A is resting on and being supported by ribs 54, and a portion of delta plate 12 is positioned within first corner groove 120. In particular, first corner groove 120 is configured to receive delta plate 12 in such a way that corner 230 and a portion of bottom edge 228 are disposed within first corner groove 120, as indicated by the broken lines within rib 54. When delta plate 12 is properly positioned within first corner groove 120, all major gaps or openings are eliminated in first internal corner 101 of condensate pan 16. Thus, because the gaps and openings are eliminated, streams of high velocity air are no longer able to bypass delta plate 12 and get in between coil slab 6A and condensate pan 16. As a result, condensation blow-off from the internal corners of condensate pan 16 is reduced or eliminated.

Figure 19A:
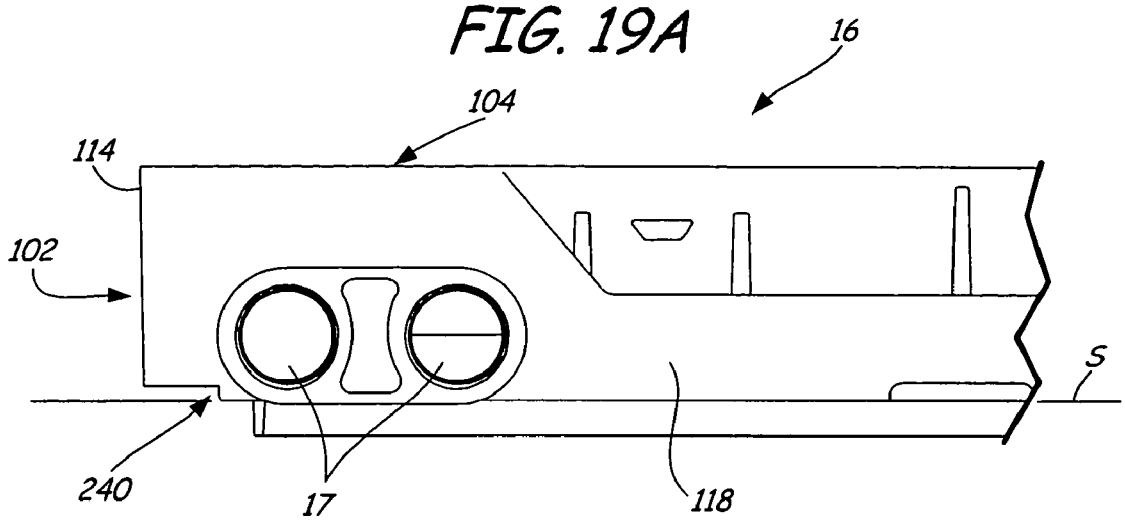
FIG. 19A is a front view of a vertical condensate pan.
Figure 19B:
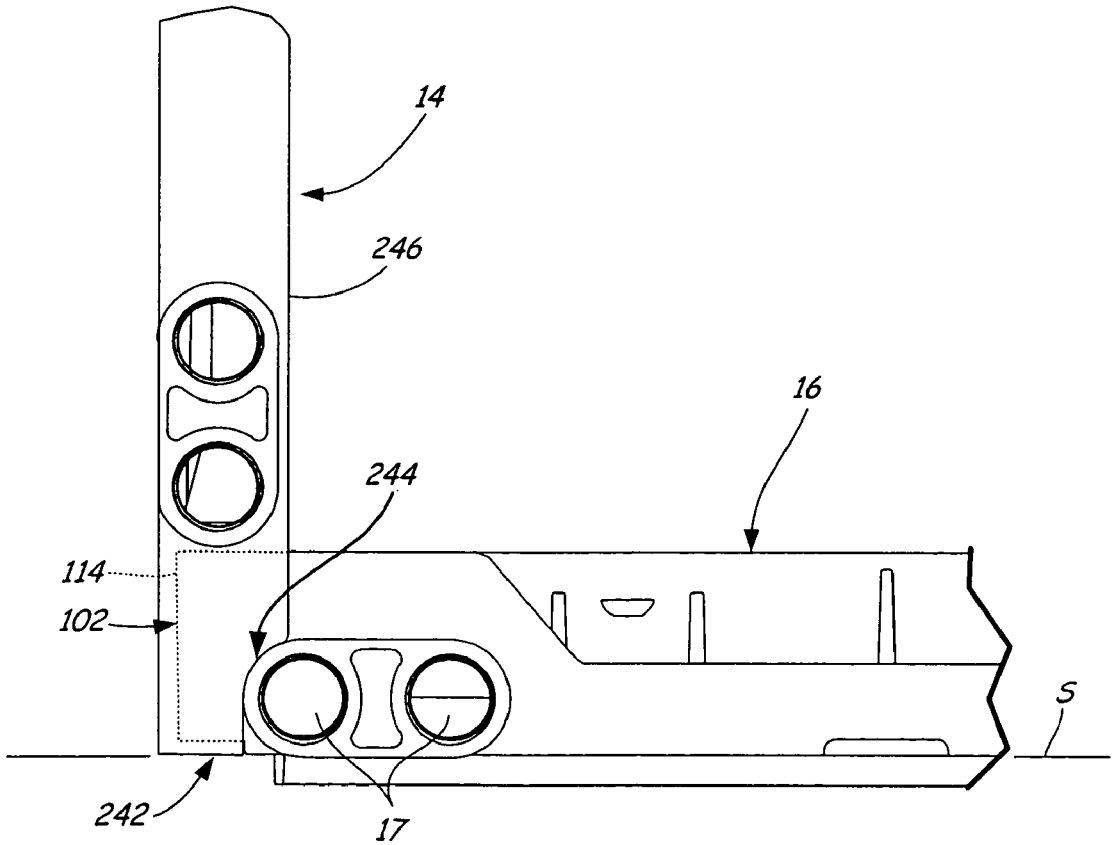
FIG. 19B is a front view of the vertical condensate pan of FIG. 19A coupled to a horizontal condensate pan.
Figure 20:
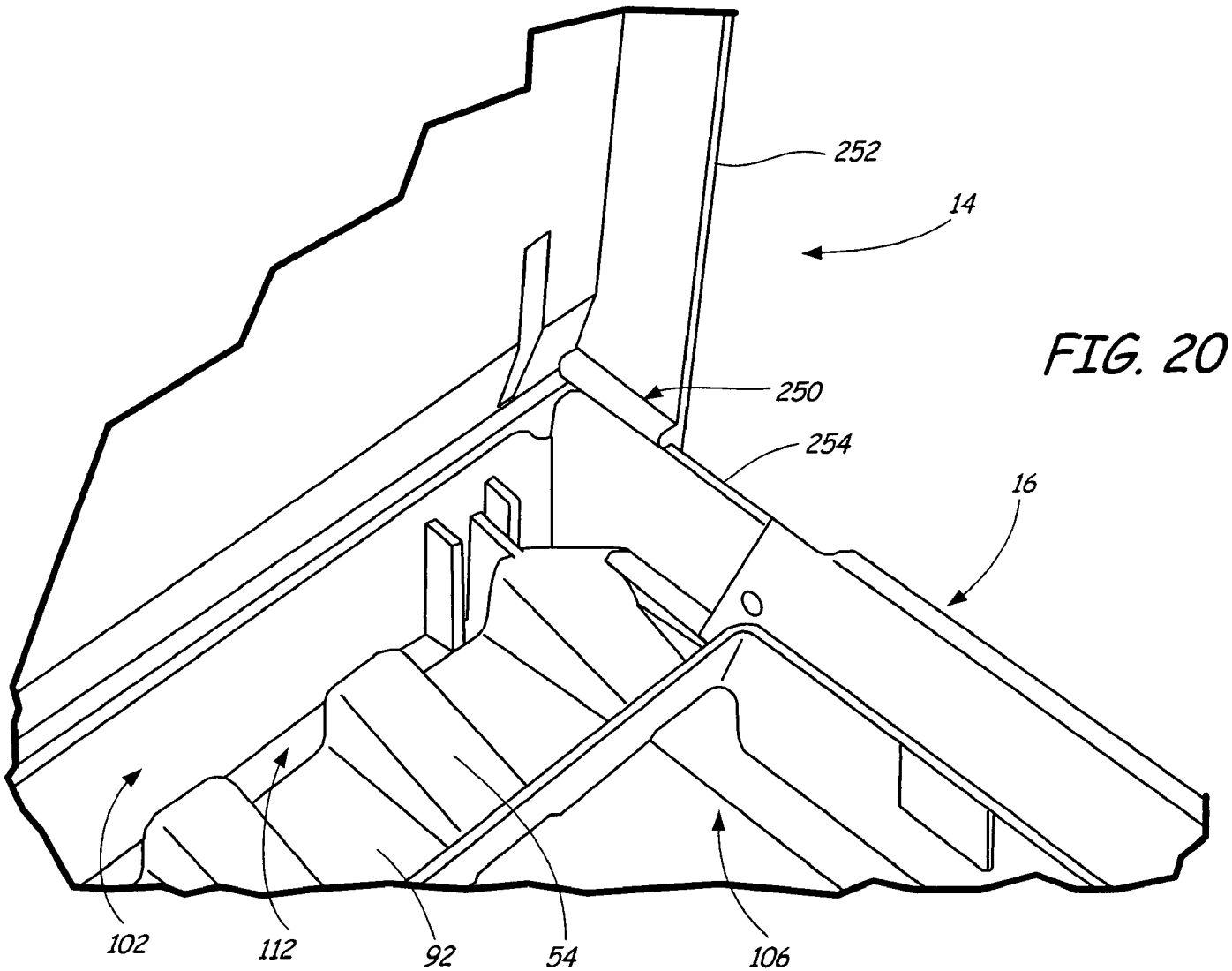
FIG. 20 is a perspective view of a corner portion of the vertical condensate pan coupled to the horizontal condensate pan.

Non-Modifying Slope Attachment of Condensate Pan 14 to Condensate Pan 16 (FIGS. 19A, 19B, and 20)

In a multi-poise A-coil such as that shown and described above in reference to FIGS. 1A and 1B, a horizontal condensate pan is used to collect condensation coming off of an evaporator coil during a horizontal application of an evaporator assembly, and a vertical condensate pan is used to collect condensation coming off of the coil during a vertical application of the evaporator assembly. In general, the horizontal and vertical condensate pans form an "L" when they are assembled together within a casing of the evaporator assembly. Although evaporator assemblies may be assembled to include only a horizontal or a vertical condensate pan (as discussed in reference to FIG. 1A), assembling the evaporator assembly with both condensate pans makes the assembly more universal by allowing use in both vertical and horizontal applications.

FIG. 19A is a front view of vertical condensate pan 16 of evaporator assembly 2 resting on surface S. As shown in FIG. 19A, a bottom side of left pan member 102 includes notch 240. Notch 240 extends along the bottom side of left pan member 102, and is configured to receive a bottom wall of horizontal condensate pan 14 when evaporator assembly 2 is assembled to include both pans 14 and 16 within casing 4. In a preferred embodiment of condensate pan 16, notch 240 is about 3 millimeters wide, which correlates with a typical thickness of a condensate pan wall.

FIG. 19B is a front view of vertical condensate pan 16 coupled to horizontal condensate pan 14. As shown by the broken lines within bottom portion 242 of condensate pan 14, pan 14 is configured to receive condensate pan 16 such that a portion of left pan member 102 is resting on an inner pan wall within bottom portion 242 of condensate pan 14. Recess 244 is configured to allow condensate pan 16 to nest within condensate pan 14 in such a way that right side 246 of pan 14 does not interfere with drain holes 17.

As shown in FIG. 19B, when condensate pans 14 and 16 are coupled together, pan 16 remains in the exact same position relative to surface S as it did prior to being coupled with pan 14 (FIG. 19A). This is an improvement over prior art designs in which coupling a vertical condensate pan with a horizontal condensate pan results in a bottom surface of the vertical condensate pan being angled relative to a surface below. An angled position of the prior art condensate pan modifies the slopes of channels within the pan, potentially creating drainage problems such as stagnation or accumulation of the collected condensation.

Evaporator assembly 2 is designed in such a way that horizontal condensate pan 14 and vertical condensate pan 16 may be coupled together without changing the slope of any condensate pan channels. As discussed previously in reference to FIGS. 3-6, vertical condensate pan 16 is designed for minimum condensation retention and quick drainage in vertical applications of coil 6. In particular, primary channels 90 and 92 are configured to direct condensation into secondary channels 108 and 112, respectively, which are then sloped toward front pan member 104 to direct the condensation into drain channel 116. Drain channel 116 is sloped in a downward direction from right pan member 100 to left pan member 102 to direct the condensation toward drain holes 17. These sloped channels are designed to optimize the flow of condensation through condensate pan 16 and out of drain holes 17. Therefore, by allowing condensate pan 14 to couple with condensate pan 16 without changing the slope of any channels, condensate pan 16 functions to properly drain condensation when evaporator assembly 2 is operating in a vertical configuration regardless of whether both pans are coupled together within casing 4.

In addition, since condensate pan 16 remains in the exact same position relative to surface S whether or not it is coupled with condensate pan 14, the position of drain holes 17 also remains constant. Thus, unlike prior art designs, it is not necessary to enlarge opening 53B of first cover 18 in order to accommodate changing locations of drain holes 17. As a result, opening 53B is designed to provide a tighter fit around drain holes 17 which, when combined with gasket 52B (as described above in reference to FIG. 1B), provides an improved airtight seal that increases the efficiency of evaporator assembly 2. In addition, the tighter fit of opening 53B around drain holes 17 is beneficial in shipping because first cover 18 is also configured to secure condensate pan 16 in position within casing 4, thereby decreasing movement of pan 16 during shipping and handling of evaporator assembly 2.

FIG. 20 is a perspective view of horizontal condensate pan 14 coupled with vertical condensate pan 16. As shown in FIG. 20, horizontal condensate pan 14 includes support member 250 on rear side 252. Support member 250 is configured to rest on top edge 254 of rear pan member 106 when horizontal condensate pan 14 is coupled with vertical condensate pan 16. Support member 250 functions to provide many important benefits to evaporator assembly 2. One benefit provided by support member 250 is a tight and rigid connection between condensate pans 14 and 16. Another benefit provided by support member 250 is a means for securing condensate pan 14 to condensate pan 16 such that the bottom wall of pan 14 remains within notch 240, as shown and described above in reference to FIG. 19B. It should be understood that notch 240 is merely one example of a support feature that may help provide a secure and rigid connection between horizontal condensate pan 14 and vertical condensate pan 16.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A method of disposing of a condensate formed on an evaporator coil including at least one coil slab, the method comprising: catching the condensate formed on the coil slab with a shield fixed to a bottom of the coil slab; directing the condensate along an angled surface of the shield toward a plurality of apertures extending through the shield, wherein the plurality of apertures are a plurality of channels; and positioned below an inner side of the coil slab; and draining the condensate through the apertures of the shield to an area of a condensate pan positioned below an outer side of the coil slab where the condensate is sheltered from contact with an air stream.

2. The method of claim 1 wherein the shield includes a bottom portion an outside portion and an inside portion, and is configured to wrap around the bottom of the coil slab.

3. The method of claim 2 wherein the outside portion of the shield includes a tab that fits into a notch on the coil slab.

4. The method of claim 1 wherein the shield is made from a thin sheet of aluminum.

5. A system for disposing of a condensate formed on an evaporator coil, the system comprising: an evaporator coil comprising a first coil slab having an inner surface and an outer surface opposite the inner surface; a condensate pan located under the evaporator coil; and a first condensate shield attached to a bottom portion of the first coil slab, the first condensate shield having a plurality of apertures located below the inner surface of the first coil slab, wherein the plurality of apertures are a plurality of channels; and wherein the first condensate shield is positioned to catch the condensate formed on the first coil slab and direct the condensate through the apertures to a portion of the condensate pan located below the outer surface of the first coil slab.

6. The system of claim 5 further comprising:

a second coil slab; and a second condensate shield attached to a bottom portion of the second coil slab and arranged to direct condensation from the evaporator coil to the condensate pan.

7. The system of claim 6 wherein the first condensate shield and the second condensate shield both comprise a bottom portion, an outside portion and an inside portion, and are configured to wrap around the bottom portion of the first coil slab and the second coil slab, respectively.

8. The system of claim 7 wherein the outside portions of the first and second condensate shields each include a lip that is configured to fit into a notch on the first coil slab and the second coil slab, respectively.

9. The system of claim 7 wherein the first coil slab and the second coil slab are three-row coils.

10. The system of claim 6 wherein the first condensate shield and the first coil slab are configured at an angle relative to the condensate pan, and the second condensate shield and the second coil slab are configured at an angle relative to the condensate pan.

11. The system of claim 6 wherein the first condensate shield is located between the first coil slab and the condensate pan and the second condensate shield is located between the second coil slab and the condensate pan.

12. The system of claim 6 wherein the evaporator coil is an A-frame.

13. The system of claim 12 wherein the A-frame is oriented vertically.

* * * * *